US011510453B2

(12) United States Patent
Musal et al.

(10) Patent No.: US 11,510,453 B2
(45) **Date of Patent: *Nov. 29, 2022**

(54) PROTECTIVE BICYCLE HELMET WITH INTERNAL VENTILATION FIT SYSTEM COMPRISING EXPANDED CONNECTORS

(71) Applicant: Bell Sports, Inc., Scotts Valley, CA (US)

(72) Inventors: Michael J. Musal, Soquel, CA (US); Christopher T. Pietrzak, Ben Lomond, CA (US)

(73) Assignee: BELL SPORTS, INC., Scotts Valley, CA (US)

( * ) Notice: Subject to any disclaimer, the term of this patent is extended or adjusted under 35 U.S.C. 154(b) by 314 days.

This patent is subject to a terminal disclaimer.

(21) Appl. No.: 16/520,198

(22) Filed: Jul. 23, 2019

(65) Prior Publication Data

US 2019/0343215 A1 Nov. 14, 2019

Related U.S. Application Data

(63) Continuation-in-part of application No. 16/365,596, filed on Mar. 26, 2019, and a continuation-in-part of application No. 15/238,507, filed on Aug. 16, 2016, now Pat. No. 10,357,077, which is a continuation of application No. 13/838,138, filed on Mar. 15, 2013, now Pat. No. 9,414,636.

(60) Provisional application No. 62/686,610, filed on Jun. 18, 2018, provisional application No. 61/621,237, filed on Apr. 6, 2012.

(51) Int. Cl.
*A42B 3/28* (2006.01)
*A42B 3/06* (2006.01)
(Continued)

(52) U.S. Cl.
CPC ..... *A42B 3/283* (2013.01); *A42B 3/066* (2013.01); *A42B 3/085* (2013.01); *A42B 3/12* (2013.01); *A42B 3/28* (2013.01); *A42B 3/281* (2013.01)

(58) Field of Classification Search
CPC .. A42B 3/12; A42B 3/28; A42B 3/066; A42B 3/281; A42B 3/283; A42B 3/085; A42B 3/14; A42B 3/32
(Continued)

(56) References Cited

U.S. PATENT DOCUMENTS 2,585,937 A * 2/1952 Johnson ..... A42B 3/14 2/182.5
3,286,275 A * 11/1966 Marchello ..... A42B 3/06 D29/104
(Continued)

FOREIGN PATENT DOCUMENTS

CN 2078979 6/1991
WO 2011139224 11/2011

*Primary Examiner* — Katherine M Moran
(74) *Attorney, Agent, or Firm* — Amardeep S. Grewal; Gerard M. Donovan; Reed Smith LLP

(57) ABSTRACT

A helmet for protecting the head of a user may include at least one liner comprising an inner surface and a lower edge surrounding the inner surface at a helmet opening configured to receive a head of a helmet wearer. At least two coupling points may be located on the inner surface proximal to the lower edge. At least one flexible forehead strap may follow the lower edge of the energy management layer and may be inwardly offset from the inner surface. At least two prongs may be coupled to, and slidably extend between, the flexible forehead strap and the at least two coupling points, respectively. A continuous gap between the inner surface and the flexible forehead strap may be provided by an offset created by the at least two prongs, the at least two prongs flexibly maintaining the offset.

20 Claims, 25 Drawing Sheets

(51) Int. Cl.
*A42B 3/08* (2006.01)
*A42B 3/12* (2006.01)

(58) Field of Classification Search
USPC ..... 2/182.1, 182.2, 182.3, 411
See application file for complete search history.

(56) References Cited

U.S. PATENT DOCUMENTS

| | | | | |
|---|---|---|---|---|
| 3,566,409 | A * | 3/1971 | Hopper | A42B 1/08 2/414 |
| 4,434,514 | A | 3/1984 | Sundahl et al. | |
| 5,477,563 | A | 12/1995 | Gentes | |
| 5,551,094 | A | 9/1996 | Navone | |
| 6,389,607 | B1 | 5/2002 | Wood | |
| 7,043,772 | B2 * | 5/2006 | Bielefeld | A42B 3/145 2/418 |
| 7,213,271 | B1 * | 5/2007 | Bielefeld | A42B 3/14 2/181 |
| 7,222,374 | B2 | 5/2007 | Musal et al. | |
| 9,021,616 | B2 * | 5/2015 | Baty | A42B 3/14 2/416 |
| 2005/0262619 | A1 | 12/2005 | Musal | |
| 2009/0293180 | A1 | 12/2009 | Grau | |
| 2010/0005573 | A1 | 1/2010 | Rudd | |
| 2013/0042397 | A1 * | 2/2013 | Halldin | A42B 3/125 2/411 |
| 2019/0380418 | A1 * | 12/2019 | Musal | A42B 3/324 |

* cited by examiner

PROTECTIVE BICYCLE HELMET WITH INTERNAL VENTILATION FIT SYSTEM COMPRISING EXPANDED CONNECTORS

CROSS REFERENCE TO RELATED APPLICATION(S)

This application is a continuation-in-part of U.S. application Ser. No. 15/238,507, filed Aug. 16, 2016, issued as U.S. Pat. No. 10,357,077, which is a continuation of U.S. application Ser. No. 13/838,138, filed Mar. 15, 2013, issued as U.S. Pat. No. 9,414,636, which application claims the benefit of and priority to U.S. Provisional Patent Application No. 61/621,237, filed Apr. 6, 2012. This application is also continuation-in-part of U.S. application Ser. No. 16/365,596, filed Mar. 26, 2019, which application claims the benefit of and priority to U.S. Provisional Patent Application No. 62/686,610, filed Jun. 18, 2018. The entire contents of each of the above references is hereby incorporated in its entirety by reference herein.

TECHNICAL FIELD

The disclosure generally relates to a protective bicycle helmet, more particularly to a protective bicycle helmet having a unique internal ventilation system and fit system having a continuous gap that allows airflow over the user's head and thus reduces heat build-up and retention, and that can provide an adjustable fit for the helmet wearer.

BACKGROUND

A physical impact to the head of a person may cause serious injury or death. To reduce the probability of such consequences, protective gear, such as a helmet, is often used in activities that are associated with an increased level of risk for a head injury. Examples of such activities include, but are not limited to, skiing, snowboarding, bicycling, rollerblading, rock climbing, skate boarding, and motorcycling. In general, a helmet is designed to maintain its structural integrity and stay secured to the head of a wearer during an impact.

Accordingly, a bicycle helmet is designed to protect the cyclist's (or wearer's) head, including to absorb and dissipate energy during an impact with a surface, such as the ground. In this regard, most bicycle helmets are designed only to withstand a single major impact, and to thereafter be replaced with a new helmet. Bicycle helmet interiors include impact attenuating materials such as an arrangement of padding and/or foam, wherein the impact attenuating materials cover and contact a significant extent of the wearer's head. In this manner, the impact attenuating materials directly or intimately contact the wearer's head, however, this arrangement can result in undesirable heat build-up and/or retention when the helmet is worn during the sporting activity. The heat build-up and/or heat retention is exacerbated in a variety of conditions, such as when the cyclist is participating in a race or training session in a warm environment.

Some bicycle helmets seek to reduce heat retention by providing openings and channels in the helmet shell and the impact attenuating materials. The openings and channels are configured to promote air movement over portions of the wearer's head. For example, a conventional helmet sold by Specialized Bicycle Components, Inc. includes a front inlet formed in the helmet shell and configured to provide for flow of inlet air onto and over the wearer's forehead. Channels are provided over and around a crown area of the head, and a rear port communicating with the channels discharges air flow supplied by the front inlet through the channels while the wearer moves in a forward direction relative to the ground. However, the impact attenuating material of this conventional helmet directly contacts the wearer's head.

SUMMARY

An aspect of the disclosure relates to a helmet for protecting the head of a user that may comprise at least one liner comprising an inner surface and a lower edge surrounding the inner surface at a helmet opening configured to receive a head of a helmet wearer. At least two coupling points may be located on the inner surface proximal to the lower edge. At least one flexible forehead strap may follow the lower edge of the energy management layer and may be inwardly offset from the inner surface. At least two prongs may be coupled to, and slidably extend between, the flexible forehead strap and the at least two coupling points, respectively. A continuous gap between the inner surface and the flexible forehead strap may be provided by an offset created by the at least two prongs, the at least two prongs flexibly maintaining the offset.

Particular embodiments or aspects may comprise one or more of the following features. The at least two prongs may comprise a stem and a head, the head having a larger cross-section than a cross-section of the stem, wherein the stem is attached to and projects away from the flexible forehead strap towards the inner surface and the head couples with the inner surface at one of the at least two coupling points. The continuous gap between the inner surface and the flexible forehead strap may be maintained by the offset created by the at least two prongs, the at least two prongs coupled to the flexible forehead strap to reduce pinch points on the flexible forehead strap for the user. An adjustable connector may be coupled to each end of the at least one flexible forehead strap and capable of adjusting a perimeter of the flexible forehead strap, wherein the adjustable connector comprises a knob that decreases the perimeter when rotated in a first direction and increases the perimeter when rotated in a second direction different from the first direction. The at least two coupling points may each comprise a hole wherein a length of the stem is greater than a depth of the hole and the stem is slidably coupled within the hole. The at least one flexible forehead strap may further comprise a pair of rails intermittently joined by transverse ribs, the rails and the ribs cooperatively coupled to define a plurality of ventilation apertures in the at least one flexible forehead strap in the form of elongated slots.

Another aspect of the disclosure relates to a helmet for protecting the head of a user that may comprise at least one liner comprising an outer shell and an energy management layer, the energy management layer comprising an inner surface and a lower edge surrounding the inner surface at a helmet opening configured to receive a head of a helmet wearer. At least one coupling point may be located on the inner surface adjacent the lower edge. At least one flexible forehead strap may follow the lower edge of the energy management layer, being inwardly offset from the inner surface, and coupled to the inner surface at the coupling points. A coupling point gap may separate the inner surface from the flexible forehead strap at each coupling point. The coupling point gap may have a length L in a range of 0.0 centimeters (cm) to 1.0 cm. An adjustable connector may be coupled to the at least one flexible forehead strap and capable of adjusting a perimeter of the flexible forehead strap.

Particular embodiments or aspects may comprise one or more of the following features. The at least one coupling point may comprise a hole wherein the stem is slidably coupled with the hole and a portion of the stem is configured to remain outside of the hole. A first of the at least one coupling point may be located in a right front portion of the inner surface and a second of the at least one coupling point being located in a left front portion of the inner surface. The flexible forehead strap comprising at least one prong comprising a stem and a head, the head having a larger cross-section than a cross-section of the stem. The stem may be attached to and project away from the flexible forehead strap towards the inner surface and the head coupling with the inner surface at the at least one coupling point. Each coupling point may be configured to receive a prong and the prong may comprise at least a pair of prongs located on the flexible forehead strap and positioned to couple with the at least one coupling point. The length L of the coupling point gap may be in a range of 0.0 cm to 0.635 cm. The adjustable connector may comprise a knob that decreases the perimeter when adjusted in a first direction and increases the perimeter when adjusted in a second direction different from the first direction.

Yet another aspect of the disclosure relates to a helmet for protecting the head of a user that may comprise at least one helmet liner comprising an outer shell and an energy management layer, the energy management layer comprising an inner surface and a lower edge surrounding the inner surface at a helmet opening configured to receive a head of a helmet wearer. At least one coupling point may be located on the inner surface proximal to the lower edge. At least one flexible forehead strap may follow a lower edge of the energy management layer, being inwardly offset from the inner surface, and being coupled to the inner surface at the coupling points. A continuous gap exists between the inner surface and the flexible forehead strap including at the at least one coupling point.

Particular embodiments or aspects may comprise one or more of the following features. The at least one coupling point may comprise a hole wherein a length of the stem is greater than a depth of the hole and a portion of the length of the stem is configured to remain outside of the hole. The at least one coupling point may comprise at least two coupling points, and a first of the at least two coupling points may be located in a right front portion of the inner surface proximal to the lower edge and a second of the at least two coupling points may be located in a left front portion of the inner surface proximal to the lower edge, wherein the at least two coupling points are proximal to a helmet wearer's head temples when in use. The at least two prongs may comprise a stem and a head, the head having a larger cross-section than a cross-section of the stem, wherein the stem is attached to and projects away from the flexible forehead strap towards the inner surface and the head couples with the inner surface at the at least one coupling point. Each coupling point may be capable of receiving a pair of prongs and the at least one prong may comprise at least one pair of prongs, located on the flexible forehead strap and positioned to couple with the at least one coupling point. The continuous gap may have a length L in a range of 0.0 cm to 0.635 cm. An adjustable connector may be coupled to the at least one flexible forehead strap and may be capable of adjusting a perimeter of the flexible forehead strap.

The inventors are also aware of the normal precepts of English grammar. Thus, if a noun, term, or phrase is intended to be further characterized, specified, or narrowed in some way, such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material, or acts in support of the function. Thus, even when the claims recite a "means for performing the function of . . . " or "step for performing the function of . . . ," if the claims also recite any structure, material, or acts in support of that means or step, or to perform the recited function, it is the clear intention of the inventors not to invoke the provisions of 35 U.S.C. § 112(f). Moreover, even if the provisions of 35 U.S.C. § 112(f), are invoked to define the claimed aspects, it is intended that these aspects not be limited only to the specific structure, material, or acts that are described in the preferred embodiments, but in addition, include any and all structures, material, or acts that perform the claimed function as described in alternative embodiments or forms in the disclosure, or that are well-known present or later-developed, equivalent structures, material, or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE DRAWINGS

To understand the present disclosure, it will now be described by way of example, with reference to the accompanying drawings.

Figure 1A:
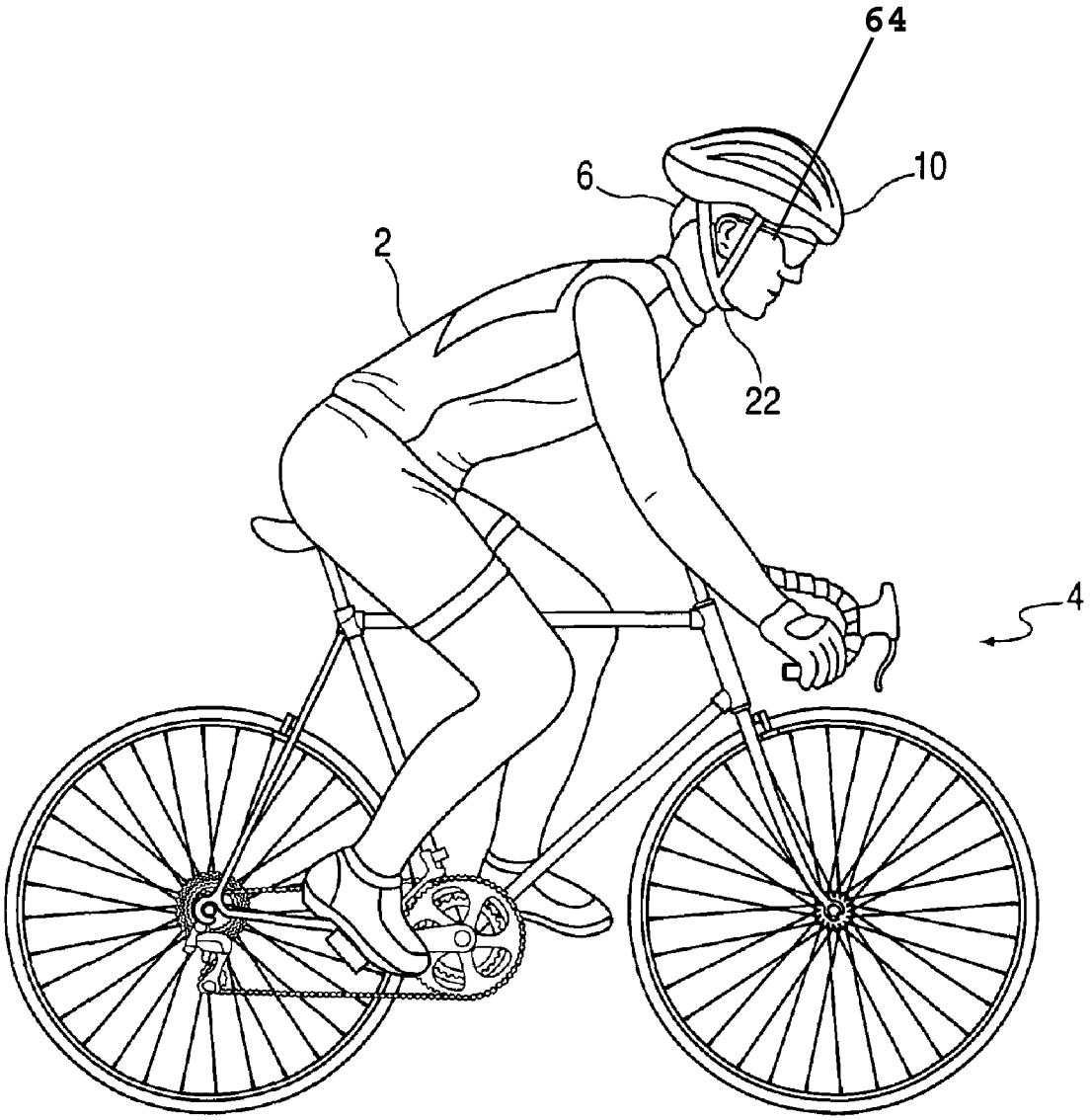
FIG. 1*a* illustrates a bicyclist wearing a bicycle helmet.

While the present disclosure will be described in connection with the preferred embodiments shown herein, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION

While this disclosure is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

In the Figures, and referring initially to FIG. 1*a*, a cyclist, user, or wearer 2 is shown riding a bicycle 4 and wearing the inventive bicycle helmet 10. The helmet 10 is secured to the head 6 of the wearer or cyclist by a chinstrap assembly 22. As discussed further below, when the cyclist 2 pedals the bicycle 4 and travels in a forward direction, air flows through the helmet 10 and over the wearer's head 6, thereby cooling the wearer's head 6.

Figure 1B:
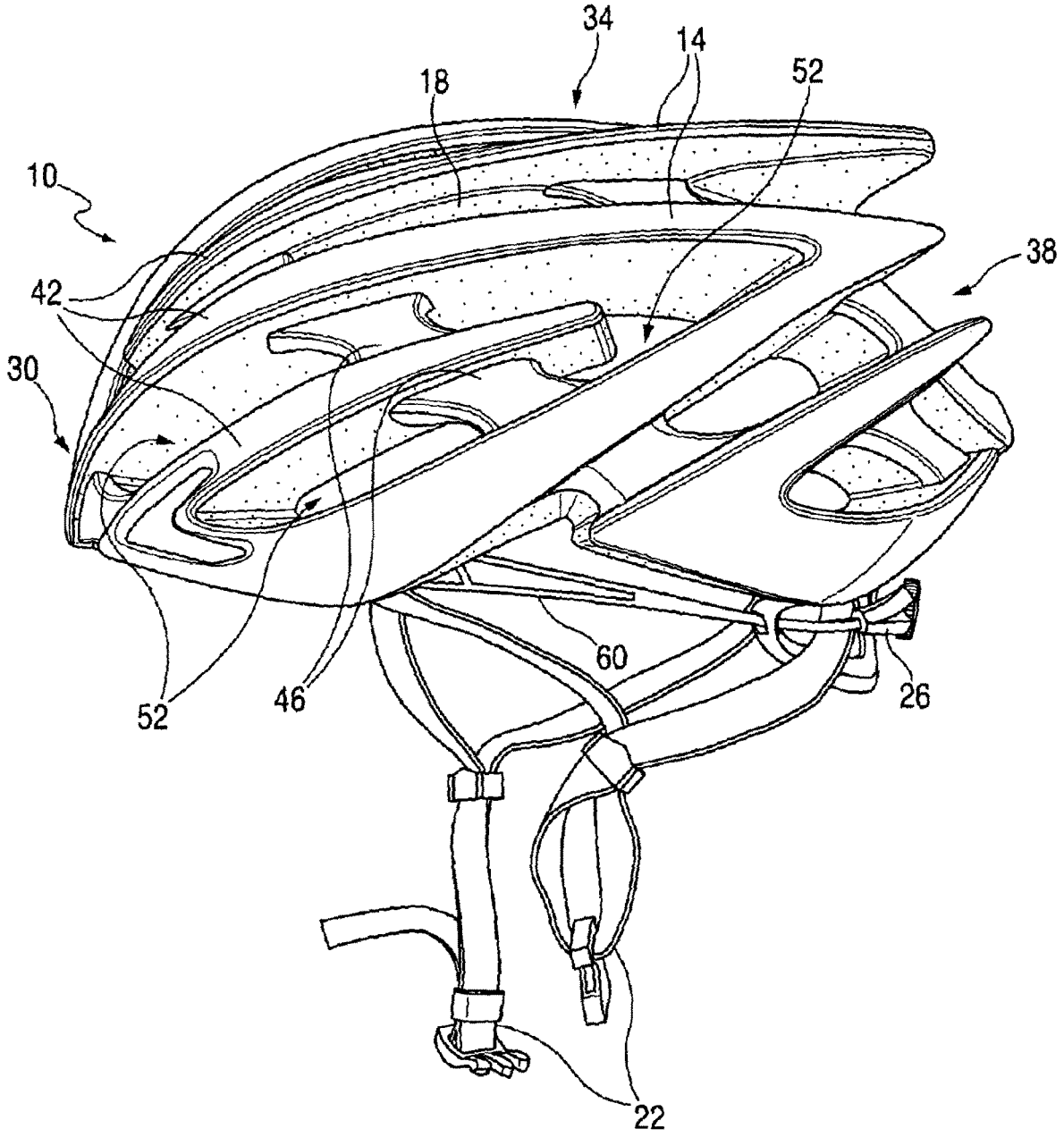
FIG. 1*b* is a left side view of an embodiment of an inventive bicycle helmet with an internal ventilation system.
Figure 2:
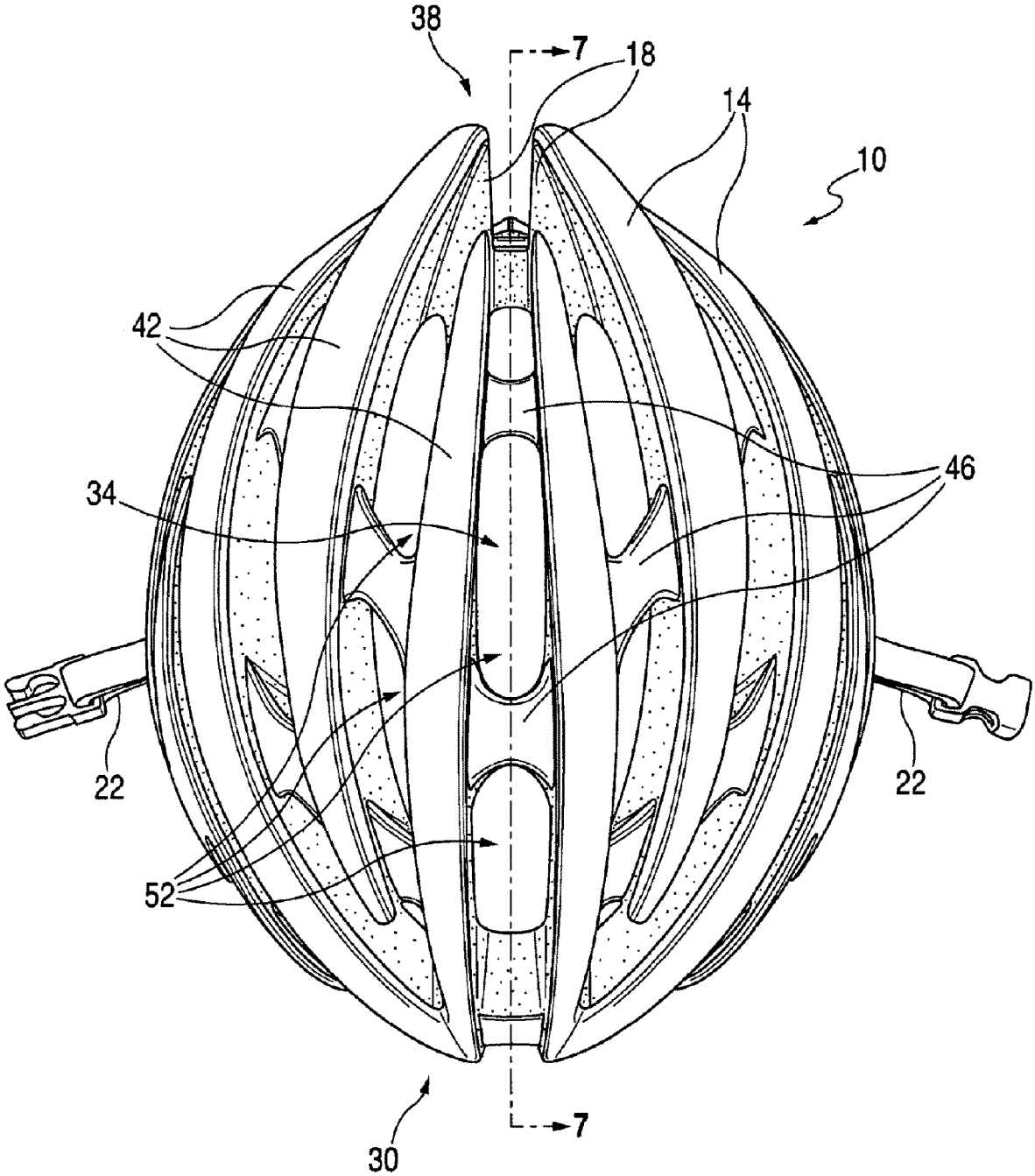
FIG. 2 is a top view of the helmet of FIG. 1*b*.
Figure 3:
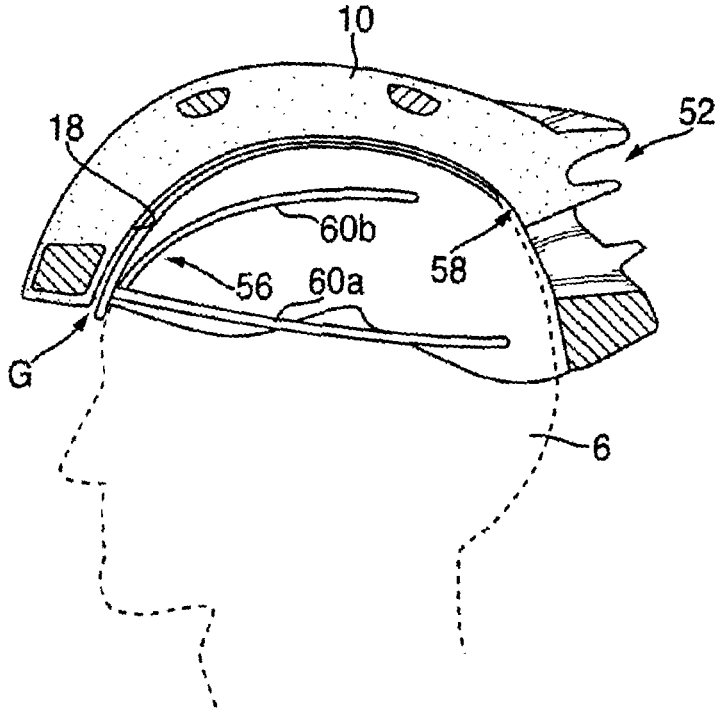
FIG. 3 is schematic side view showing the helmet of FIG. 1*b* in partial section and secured to the head of a wearer.
Figure 4:
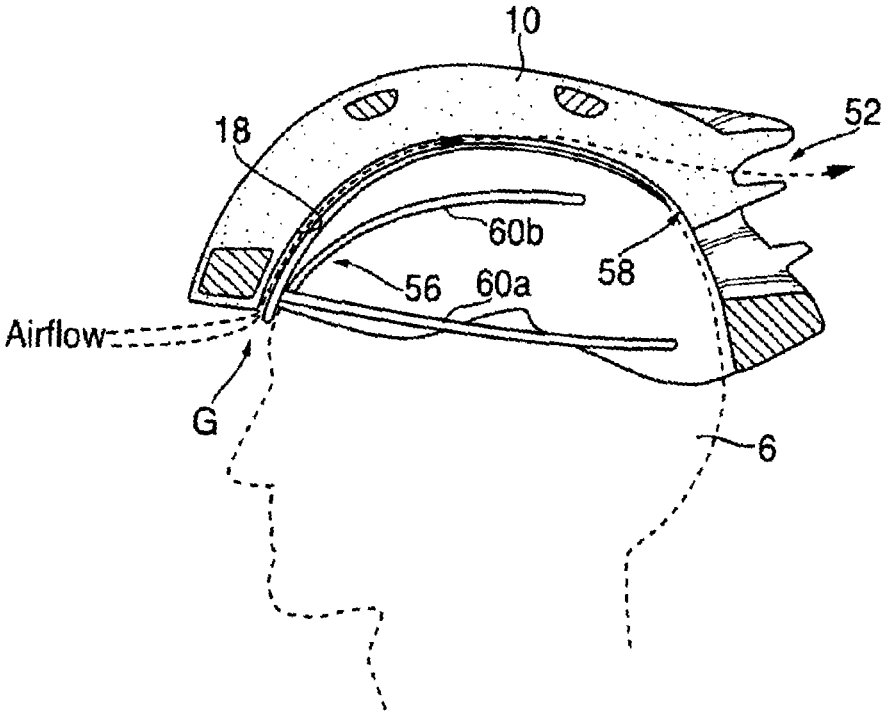
FIG. 4 is a schematic side view similar to FIG. 3 showing airflow through the helmet.
Figure 5:
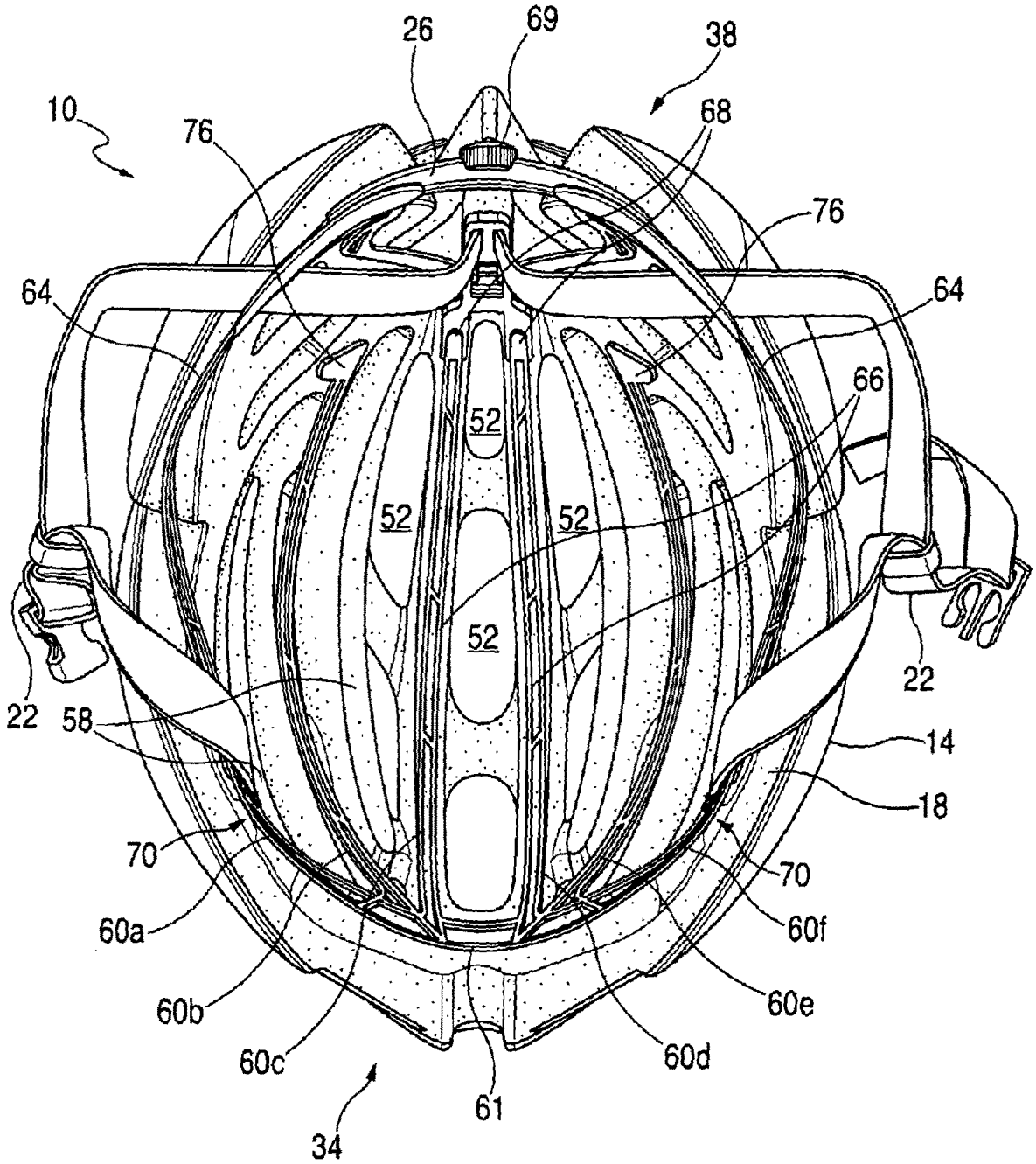
FIG. 5 is a bottom view of the helmet of FIG. 1*b* showing an internal ventilation system.

Referring also to FIGS. 1*b* and 2, an embodiment of the helmet 10 in accordance with the present disclosure is shown and includes a relatively hard, impact-resistant outer shell 14, at least one energy dissipating inner layer 18, the chinstrap assembly 22 for securing the helmet 10 to the wearer's head 6, and an adjustment mechanism 26 for adjusting the fit of the helmet 10 on the wearer's head 6. In some embodiments the outer shell 14 comprises a hard plastic material, such as polycarbonate; however, in other embodiments, the outer shell 14 may also or alternatively comprise KEVLAR, ABS plastic, carbon fiber, fiberglass, and the like. In some embodiments, the inner layer 18 comprises expanded polystyrene (EPS), expanded polypropylene (EPP), expanded polyolefin (EPO), or other energy management or energy absorbing materials. The chinstrap assembly 22 includes connectable segments attached to one or both of the outer shell 14 and the inner layer 18 for securing the helmet 10 to the wearer's head 6, as generally known in the art. The helmet 10 includes a frontal portion 30 that overlies the wearer's forehead, a top or crown portion 34 that overlies the crown region of the wearer's head 6, and a rear portion 38 that overlies at least the wearer's occipital region.

In the illustrated embodiment, the helmet 10 includes a plurality of ribs 42 extending longitudinally substantially between the frontal and rear portions 30, 38 and connected by generally laterally extending webs 46, such as to form a web, mesh, or lattice. The ribs 42 and webs 46 cooperate to define ventilation openings 52 that extend through the helmet 10 from the helmet exterior to the helmet interior. The helmet 10 of FIGS. 1*a*-13 is what is known in the cycling field as a "road" helmet and is designed for general use during recreational and certain types of competitive cycling. It should be appreciated that the inventive concepts and teachings discussed herein are equally applicable to other types of bicycle helmets, such as a "sprinter" helmet, as shown in FIG. 14, and an "aero" helmet. As shown in FIG. 14 and as understood by those in the art, a sprinter helmet is designed to be more aerodynamic than the illustrated road helmet 10, and as such has a more smoothly contoured outer shell 14 and fewer ventilation openings 52. As also understood by those in the art, an aero helmet is designed to be even more aerodynamic, having a substantially streamlined shape that resembles a "tear-drop" configuration. Aero helmets are also configured to have as few ventilation openings 52 as possible, and in many cases have no ventilation openings whatsoever. As those skilled in the art will come to appreciate, the benefits and advantages associated with the inventive concepts and teachings discussed herein may become more apparent to the wearer as the number of ventilation openings 52 in the helmet 10 decrease.

Referring also to FIGS. 3-7, the helmet 10 includes an internal ventilation system 56 that adjustably contacts the wearer's head 6 to support the helmet 10 while defining a ventilation gap G or offset between the wearer's head 6 and an inner surface 58 of the inner helmet layer 18. In some instance, the ventilation gap G will be formed or maintained by prongs 342, as shown, e.g., in FIGS. 19A-22. This ventilation gap G extends across the outer surface of the wearer's head 6 from the wearer's forehead region over the crown region and to the occipital region. Because the inner surface 58 of the inner layer 18 is spaced apart from the wearer's head 6, ventilating air can flow through the gap G and between the wearer's head 6 and the inner surface 58. This ventilation gap G is provided in helmets having several ventilation openings 52, such as the illustrated helmet 10, and also is provided in helmets having few or no ventilation openings, such as the sprinter and aero helmets discussed above.

Figure 8:
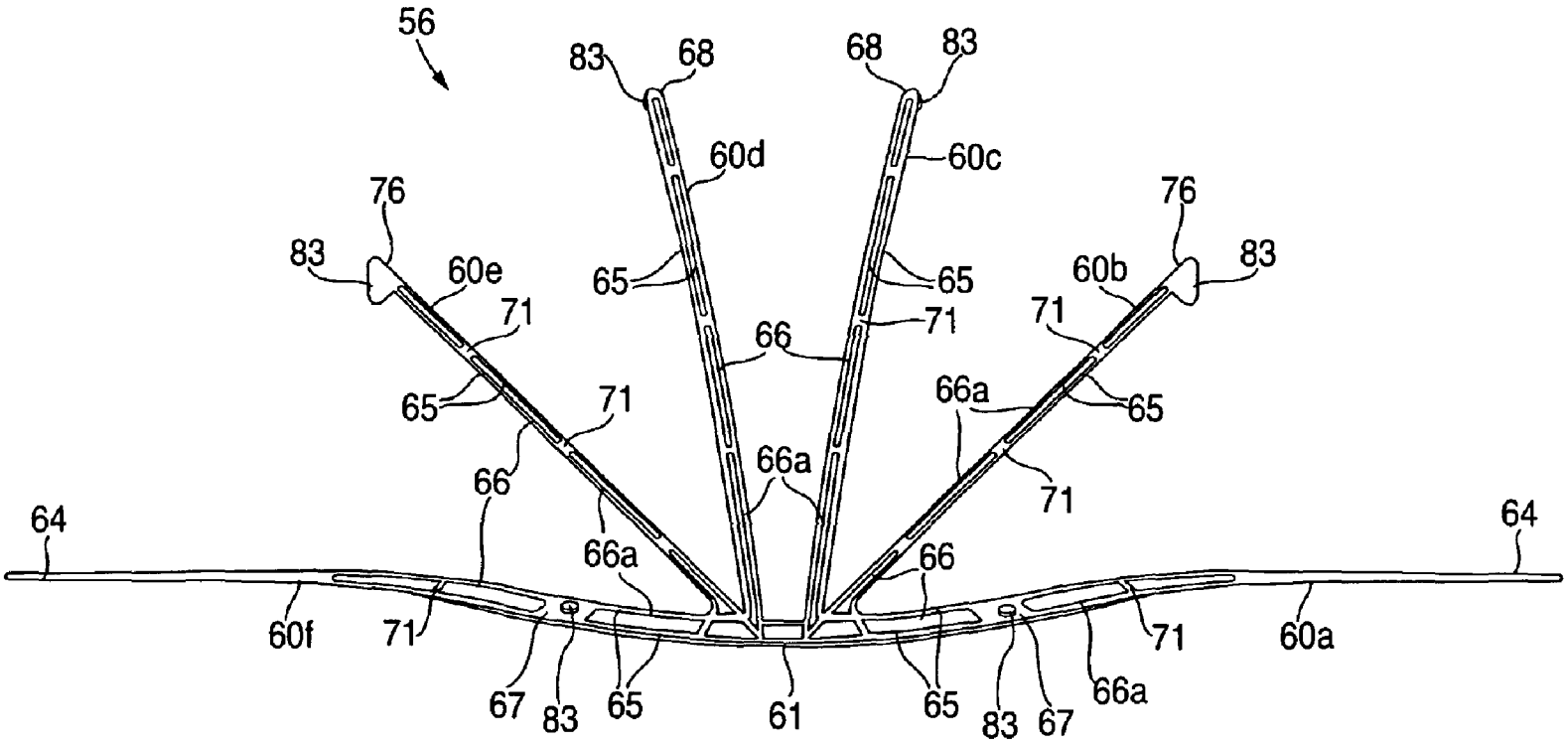
FIG. 8 is a plan view showing the internal ventilation system for the helmet of FIG. 1*b* in an uninstalled configuration.

Referring also to FIG. 8, the illustrated embodiment of the internal ventilation system 56 is in the form of a web-like structure that includes a plurality of generally longitudinally extending fingers 60 *a*, 60 *b*, 60 *c*, 60 *d*, 60 *e*, and 60 *f* (referred to collectively hereinafter as fingers 60). The fingers 60 generally converge with one another at a front portion 61 of the internal ventilation system 56, which is located substantially at the frontal portion 30 of the helmet 10 when the internal ventilation system 56 is installed in the helmet 10. As shown in FIG. 8, when not installed in the helmet 10 the internal ventilation system 56 is substantially flat and the fingers 60 extend away from the front portion 61. The internal ventilation system 56 is flexible such that, when installed in the helmet 10, the fingers 60 are curved and generally follow the curvature of the inner layer 18.

Each of the fingers 60 has a pair of rails 65 intermittently joined by transverse ribs 71. The rails 65 and the ribs 71 cooperate to define a plurality of finger ventilation apertures 66 in the form of generally elongated slots 66 *a*. The finger ventilation apertures 66 can further improve the ventilating characteristics of the internal ventilation system 56 by minimizing the total surface area of the internal ventilation system 56 that is in intimate contact with the wearer's head 6. Alternatively, the fingers 60 are configured with a single rail 65 that precludes the apertures 66. Some embodiments of the internal ventilation system 56 are formed of a substantially rigid but flexible material, such as rubber, plastic, carbon fiber, and the like. The fingers 60 may also include an additional material, such as a coating, to facilitate engagement with the wearer's head 6.

The fingers 60 of the illustrated embodiment are arranged substantially in pairs. A first pair of the fingers 60 includes the outer fingers 60 *a* and 60 *f* that extend generally from the helmet frontal portion 30 toward the helmet rear portion 38 by extending laterally around the side portions of the helmet 10. The outer fingers 60 *a*, 60 *f* include pad portions 67 that, in the illustrated embodiment, are located approximately one-quarter to one-third of the way rearward along the length of the outer fingers 60 *a*, 60 *f*. The pad portions 67 lack ventilation apertures 66 and are provided for securing the outer fingers 60 *a*, 60 *f* to the helmet 10. More specifically, the pad portions 67 are attached to a pair of front attachment locations 70 that offset the outer fingers 60 *a*, 60 *f* from the inner surface 58 of the helmet 10, as discussed further below. Distal ends 64 of the outer fingers 60 *a*, 60 *f* extend into the adjustment mechanism 26 located substantially adjacent the rear portion 38 of the helmet 10.

When the helmet 10 is properly worn, the outer fingers 60 *a*, 60 *f* extend laterally from the wearer's forehead, around the sides of the wearer's head 6, passing approximately over the wearer's temples, and into the adjustment mechanism 26. In some embodiments, including the illustrated embodiment, the adjustment mechanism 26 is configured for direct engagement with the wearer's head 6 and includes an actuator 69 (such as a dial, knob, or other adjustor that reels in or pays out the distal ends 64 of the outer fingers 60 *a*, 60 *f*) to adjust the fit of the internal ventilation system 56. For example, by reeling in the distal ends 64 of the outer fingers 60 *a*, 60 *f*, the internal ventilation system 56 is tightened against the wearer's head 6, whereas by paying out the distal ends 64 of the outer fingers 60 *a*, 60 *f*, the internal ventilation system 56 is loosened from the wearer's head 6. In this regard, the outer fingers 60 *a*, 60 *f* are adjustable to account for the size of the wearer's head 6.

It should be understood that use and incorporation of the adjustment mechanism 26 with the internal ventilation system 56 is not required. For example, in some embodiments, the internal ventilation system 56 may be of a substantially fixed size and configuration, wherein such variations in the size or shape of a wearer's head may be accommodated by the flexibility of the materials of the system 56. In either event, the internal ventilation system, whether or not adjustable, will provide a gap G that will facilitate airflow and cooling. Furthermore, for any of the structures or arrangements described herein, the internal ventilation system or gap G may comprise prongs 342 or other similar or suitable structures, such as blades, as described herein. Some embodiments may also or alternatively or additionally include fit adjusting components or structures distinct from, or that are part of or work in tandem with, the internal ventilation system 56. For example, in one exemplary embodiment the outer fingers 60 *a*, 60 *f* terminate near the front attachment locations 70, and a separate strap, band, or similar structure may be provided that extends generally around the rear occipital region of the wearer's head 6. The strap, band, or similar structure may formed of a resilient material, such as elastic, and may therefore be inherently adjustable, or the strap, band or similar structure may be operably connected to an adjustment mechanism similar to the adjustment mechanism 26 discussed above.

Referring again to the embodiment illustrated in FIGS. 3-8, a second pair of the fingers 60 includes the innermost fingers 60 *c* and 60 *d* that extend generally rearward along the inner helmet surface 58 from the frontal portion 30, along the crown portion 34, and toward the rear portion 38 of the helmet 10. Distal ends 68 of the innermost fingers 60 *a*, 60 *f* are attached to the interior of the helmet 10 at first rear attachment locations 72 (FIG. 7), which are raised relative to the inner helmet surface 58 of the helmet 10, as discussed further below. When the helmet 10 is properly worn, the innermost fingers 60 *c*, 60 *d* extend generally from the wearer's forehead and over the crown of the wearer's head 6.

A third pair of the fingers 60 includes the intermediate fingers 60 *b* and 60 *e* that extend generally upwardly and outwardly along the inner helmet surface 58 from the frontal portion 30, around and over the wearer's head 6, and inwardly and downwardly toward the rear portion 38. Distal ends 76 of the intermediate fingers 60 *b*, 60 *e* are attached to the interior of the helmet 10 at second rear attachment locations 80 (FIG. 7), which are raised relative to the inner surface 58 of the helmet 10, as discussed further below. When viewed from the front of the helmet 10, the intermediate fingers 60 *b*, 60 *e* are oriented at approximately 90 degrees with respect to one another, and extend over the wearer's head 6 at a location substantially mid-way between the outer fingers 60 *a*, 60 *f* and the innermost fingers 60 *c*, 60 *d*.

Although the illustrated helmet 10 includes six fingers 60, it should be appreciated that more or fewer fingers, and fingers having different shapes, sizes, configurations, and orientations may be utilized. For example, a heavier helmet may require additional support and, as such, additional or larger fingers, and additional attachment points may be incorporated into the internal ventilation system 56 and into the inner layer 18. In another exemplary embodiment, rather than two innermost fingers 60 *c*, 60 *d*, a single center finger extending substantially down the middle of the helmet 10 may be provided. In still other embodiments, the innermost fingers 60 *c*, 60 *d* may be removed entirely, leaving the two intermediate fingers 60 *b*, 60 *e*. In still other embodiments, rather than including fingers 60 that extend generally from front to back, the internal ventilation system 56 may include fingers 60 that extend transversely from side to side and/or generally diagonally through the helmet 10. In such alternative embodiments, the specific position of the attachment locations may be changed to account for the different orientation of the fingers 60.

Other embodiments of the internal ventilation system 56 may also or alternatively include one or more annular structures coupled to the inner layer 18 at suitably positioned attachment locations. Such annular structures may be complete circles or partial circles configured to directly engage crown portions of the wearer's head 6. The annular structures may be arranged generally in a concentric fashion, with the smallest annular structure positioned nearest a top of the wearer's head 6, and with larger annular structures being positioned lower on the wearer's head 6. The concentric structures may be joined to one another by generally radially extending web sections, or may be individually coupled to attachment locations provided on the inner layer 18 and offset from the inner helmet surface 58. Some embodiments may also include a combination of one or more annular structures and one or more fingers 60. The one or more annular structures can be combined with fingers 60 extending generally front to back, side to side, diagonally, or any combination thereof.

In the illustrated embodiment of FIG. 8, each of the pad portions 67 and the distal ends 68, 76 of the innermost fingers 60 *c*, 60 *d* and the intermediate fingers 60 *b*, 60 *e* are provided with a mounting projections 83 that extend outwardly (for example out of the page as viewed in FIG. 8) from their respective fingers 60. The mounting projections 83 of the illustrated embodiment are inserted into the appropriate front mounting location 70, first rear mounting location 72, or second rear mounting location 80 and help secure the internal ventilation system 56 to the inner layer 18 of the helmet 10.

Figure 9:
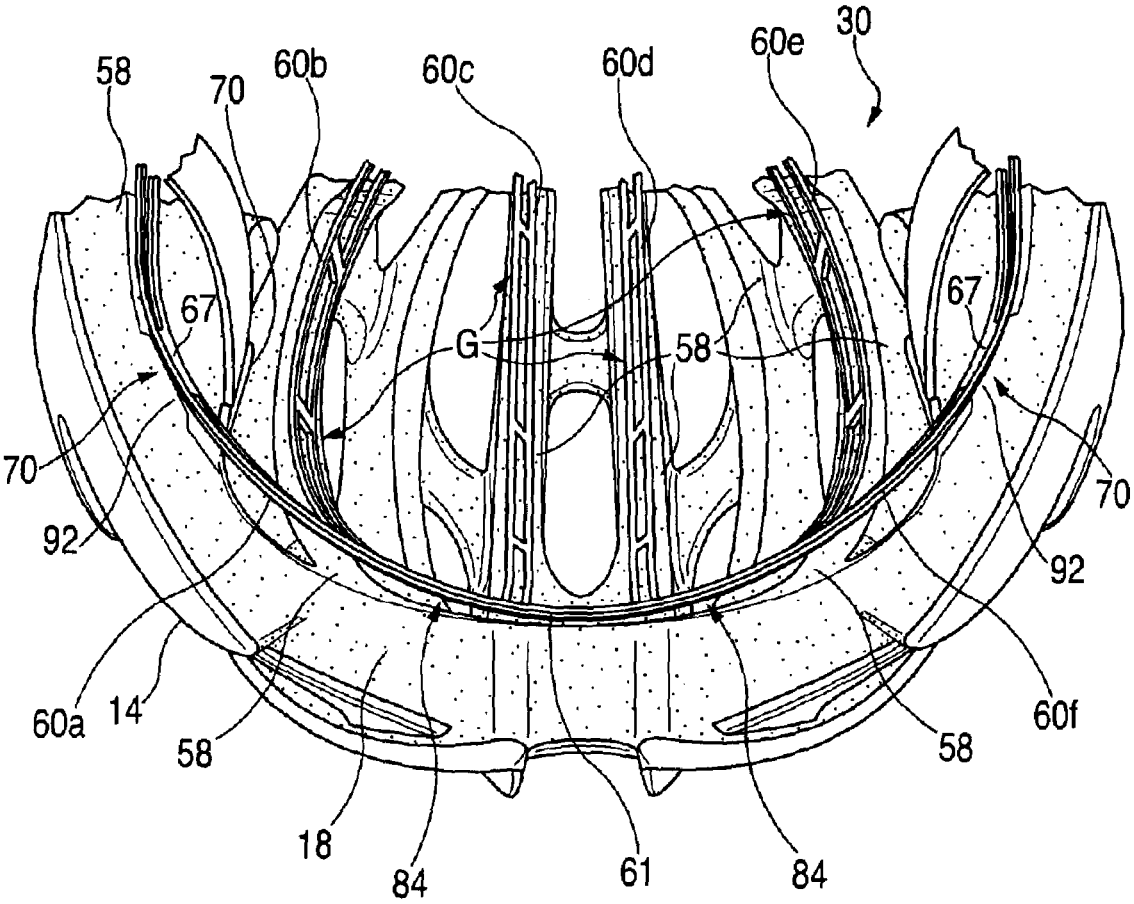
FIG. 9 is an enlarged bottom view showing a frontal portion of the helmet of FIG. 1.
Figure 10:
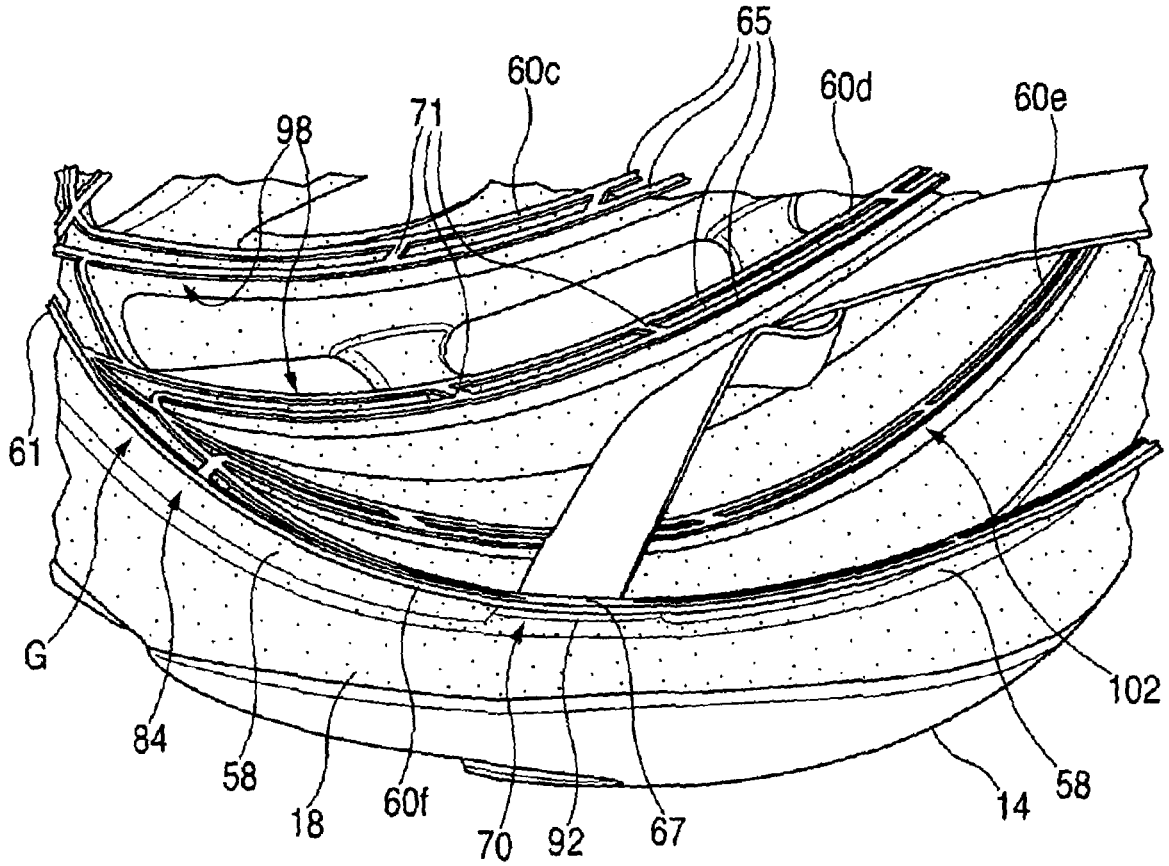
FIG. 10 is an enlarged bottom left perspective view of the helmet of FIG. 1*b* showing a forward attachment location for the internal ventilation system.

Referring also to FIGS. 9 and 10, the front portion 61 of the internal ventilation system 56 is spaced from the frontal portion 30 of the helmet 10 by a forehead gap 84. The forehead gap 84 forms part of the overall gap G (namely the leading portion of the gap G) discussed above that offsets the inner surface 58 of the helmet 10 from the wearer's head 6. The forehead gap 84 is provided by the pair of front attachment locations 70, to which the pad portions 67 of the outer fingers 60 *a*, 60 *f* are attached, for example by way of the mounting projections 83. In some embodiments, including the illustrated embodiment, the front attachment locations 70 are integrally formed with the inner layer 18, and are defined by raised projections 92 that extend generally inwardly from the inner surface 58 of the helmet 10. In this manner, the front attachment locations 70 are further inward than the adjacent portions of the inner layer 18. Other embodiments may include front attachment locations 70 in the form of standoffs, posts, spacers, and the like that are joined to the inner layer 18. In the illustrated embodiment, the pad portions 67 of the outer fingers 60 *a*, 60 *f* are secured to the front attachment locations 70 by adhesive. However, in other embodiments the pad portions 67 or some other portions of the outer fingers 60 *a*, 60 *f* can be secured to front attachment locations 70 by clips, clamps, snaps, hook and loop, and other types of fasteners.

Figure 6:
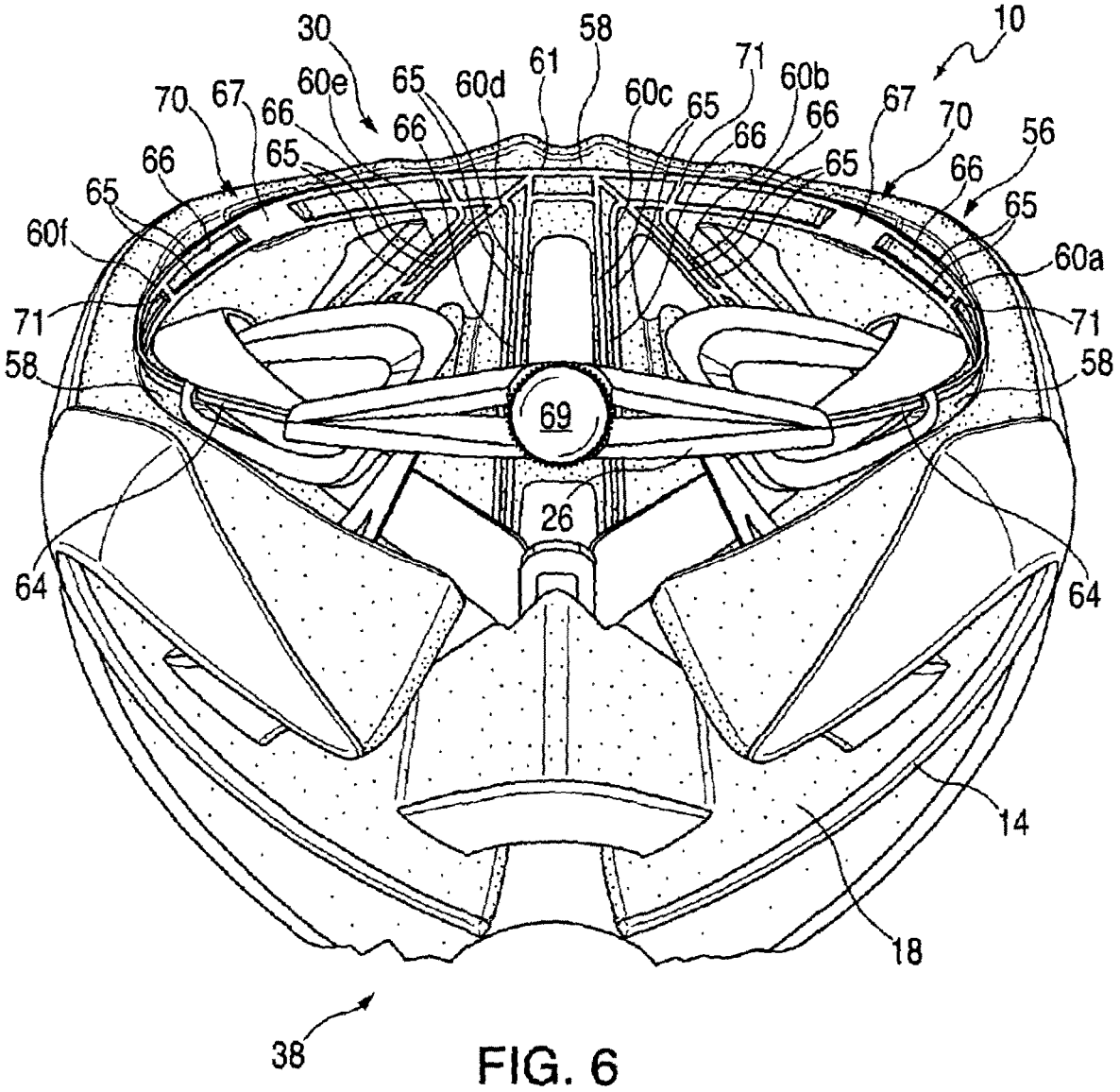
FIG. 6 is an enlarged rear perspective view of the helmet of FIG. 1*b*.
Figure 7:
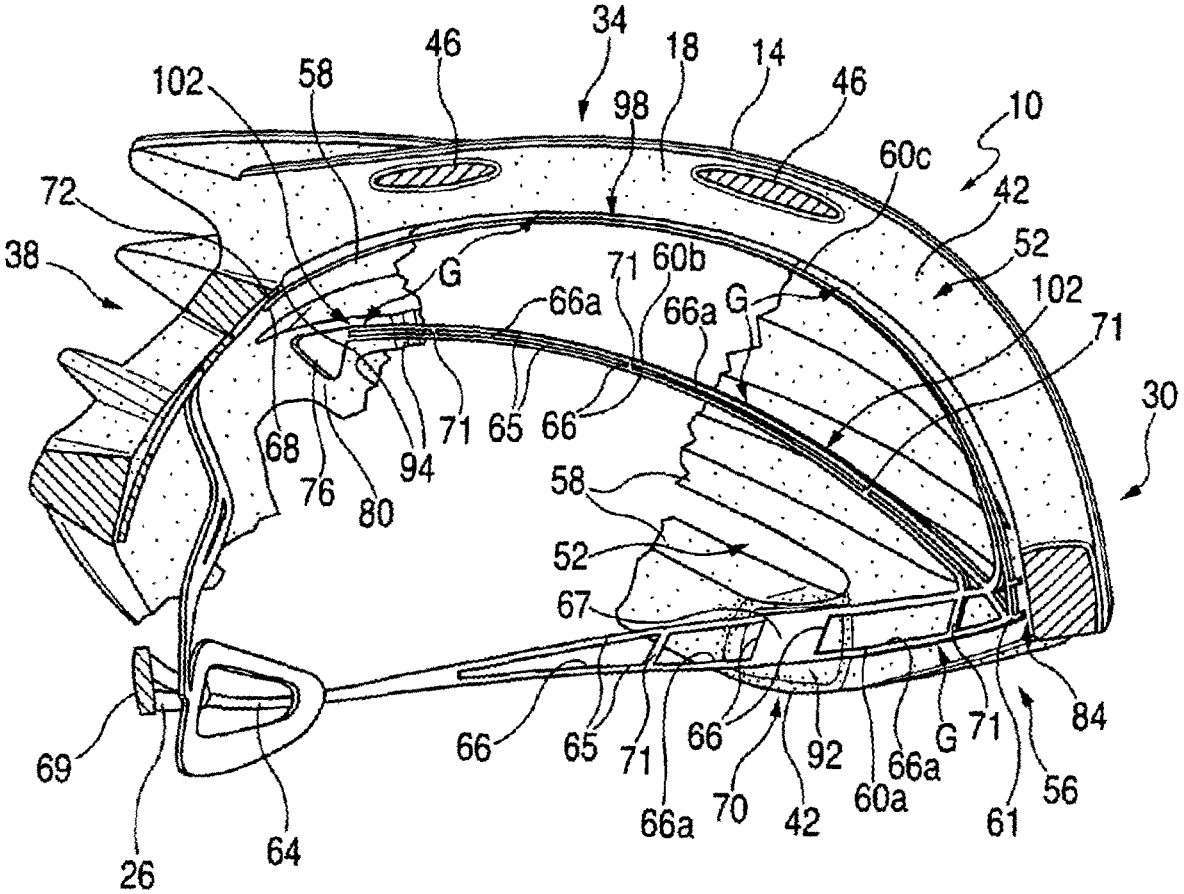
FIG. 7 is a section view taken through line 7-7 of FIG. 2, and with portions of the helmet removed for drawing clarity.

As best shown in FIGS. 6-9, in the illustrated embodiment, the front attachment locations 70 are located approximately one-quarter to one-third of the helmet periphery from the frontal portion 30 of the helmet 10, with one front attachment location 70 located on each side of the helmet 10. The location and configuration of the front attachment locations 70, along with the configuration of the outer fingers 60 *a*, 60 *f*, are such that the forehead gap 84 between the front portion 61 of the internal ventilation system 56 and the inner surface 58 of the helmet 10 remains substantially constant over the curved section that extends between the front attachment locations 70. Moreover, the forehead gap 84 remains substantially unchanged when the helmet 10 is worn by the wearer 2. As best shown in FIG. 6, the sides and distal ends 64 of the outer fingers 60 *a*, 60 *f* are similarly spaced away from the inner surface 58 of the helmet 10 to maintain the gap G between the inner surface 58 of the helmet 10 and the wearer's head 6. As such, during forward movement the forehead gap 84 allows air contacting the wearer's forehead to flow upwardly and over the wearer's head 6.

Figure 11:
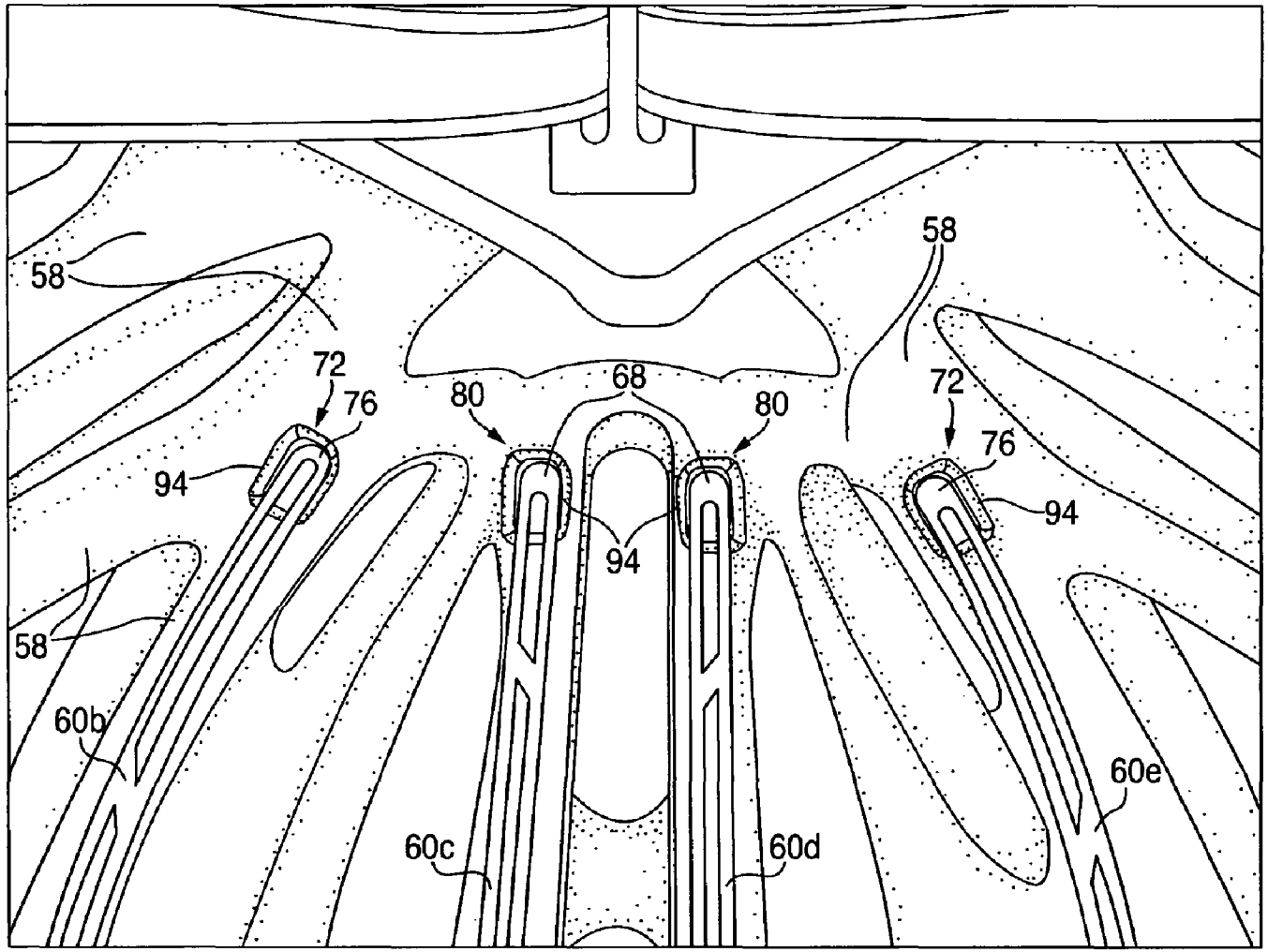
FIG. 11 is an enlarged bottom view of the helmet of FIG. 1*b* showing rear attachment locations for the internal ventilation system.

Referring also to FIG. 11, the intermediate fingers 60 *b*, 60 *e* and the innermost fingers 60 *c*, 60 *d* each extend rearwardly from the front portion 61 of the internal ventilation system 56 to respective first rear attachment locations 72 and second rear attachment locations 80. In some embodiments, including the illustrated embodiment, the first and second rear attachment locations 72, 80 are integrally formed with the inner layer 18, and are defined by raised projections 94 that extend generally inwardly from the inner surface 58 of the helmet 10. In this manner, the first and second rear attachment locations 72, 80 are further inward than the adjacent portions of the inner layer 18. Other embodiments may include attachment locations, such as first and/or second rear attachment locations 72, 80 in the form of prongs 342, standoffs, posts, spacers, and the like that are joined to the inner layer 18. Moreover, in the illustrated embodiment, the distal ends 68, 76 of the respective innermost fingers 60 *c*, 60 *d* and outer fingers 60 *b*, 60 *e* are secured to the first and second rear attachment locations 72, 80 by adhesive. However, in other embodiments the distal ends 68, 76 or some other portions of the innermost fingers 60 *c*, 60 *d* and/or the outer fingers 60 *b*, 60 *e* can be secured to rear attachment locations 72, 80 by clips, clamps, snaps, hook and loop, and other types of fasteners.

Figure 12:
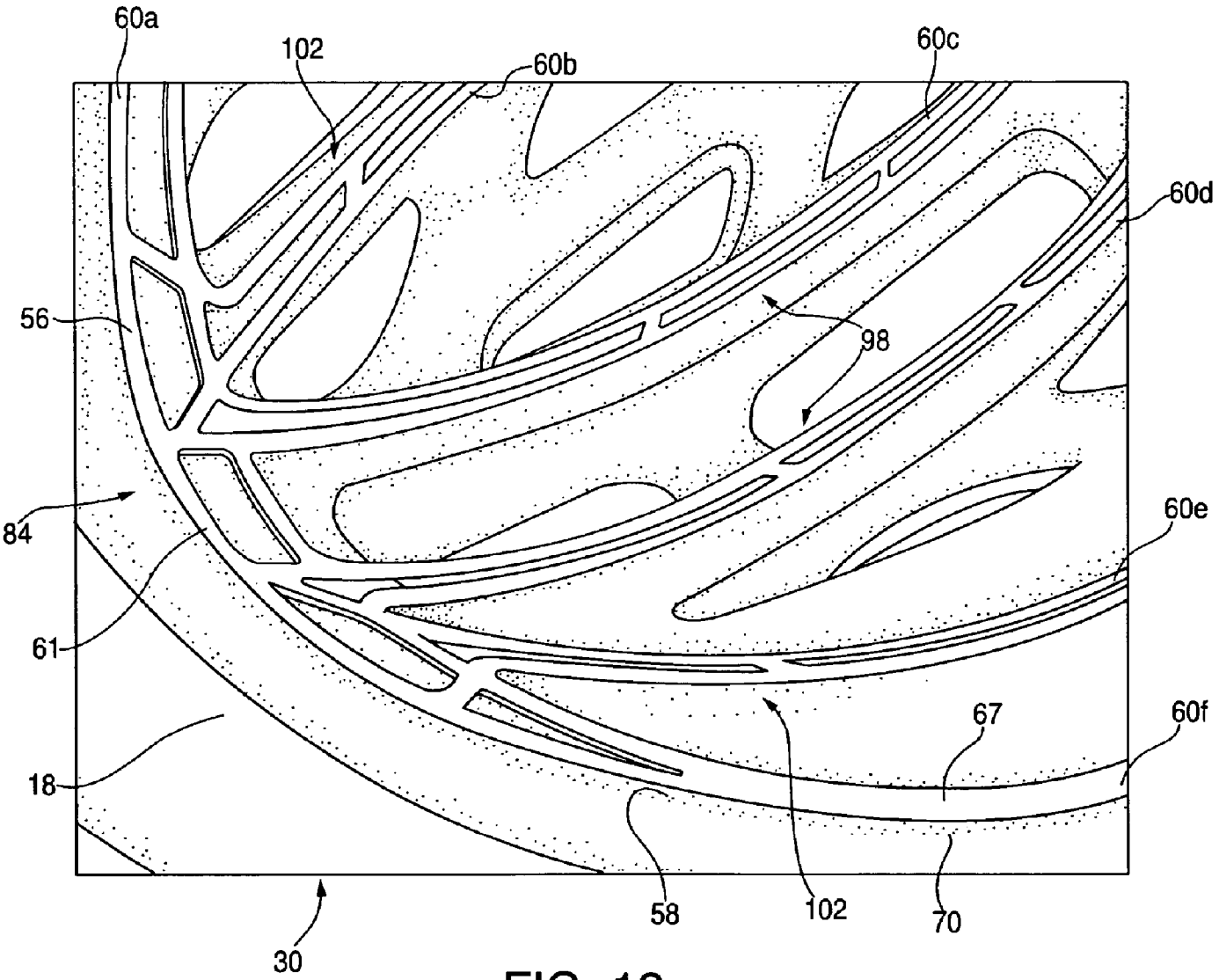
FIG. 12 is an enlarged bottom left perspective view of the helmet of FIG. 1*b* showing the frontal portion of the helmet and a front portion of the internal ventilation system.
Figure 13:
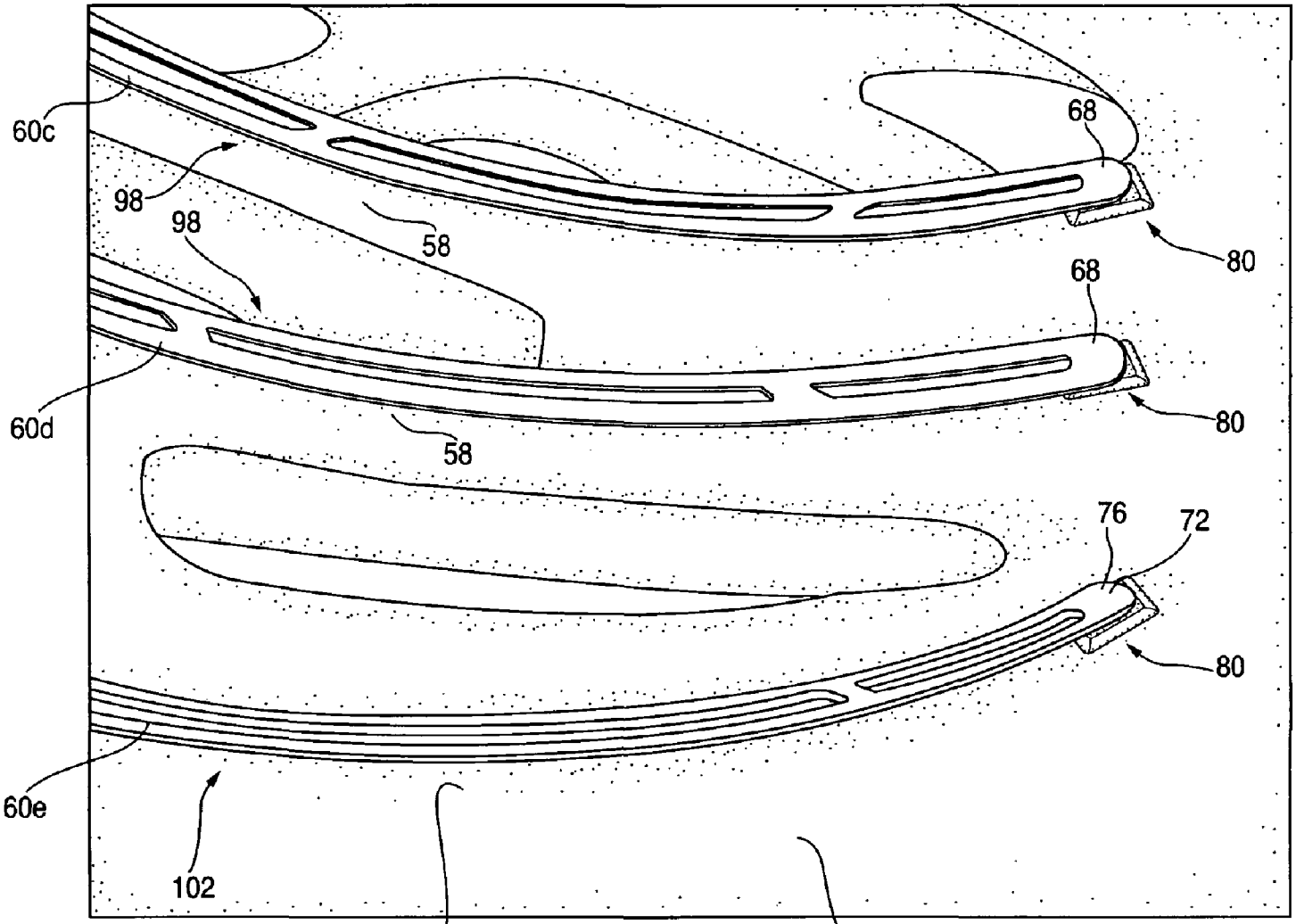
FIG. 13 is an enlarged bottom left perspective view of the helmet of FIG. 1*b* showing the rear attachment locations for the internal ventilation system.
Figure 14:
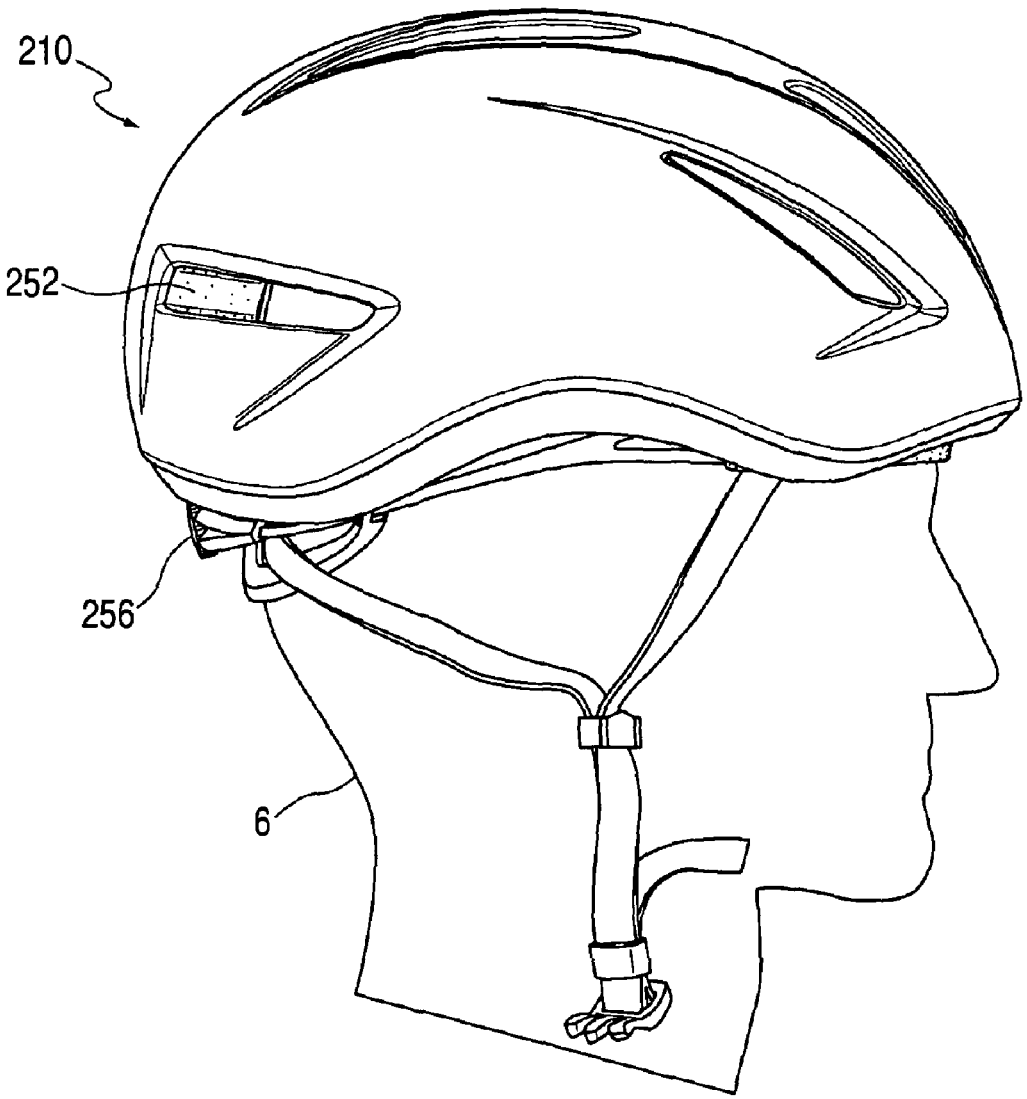
FIG. 14 is a side view of an alternative embodiment of an inventive bicycle helmet with an internal ventilation system.

As shown throughout the Figures, including also FIGS. 12 and 13, the internal ventilation system 56 is supported or otherwise spaced away from the inner surface 58 of the helmet 10, such as by one or more of the front attachment locations 70, first and second rear attachment locations 72, 80, and by prongs 342. When the helmet 10 is worn, the fingers 60 of the internal ventilation system 56, or other suitable portion of the helmet, such as flexible forehead strap 314, may intimately contact the wearer's head 6, while the inner helmet surface 58 of the helmet is spaced away from the wearer's head 6 to form the gap G. In this manner the inner surface 58 is offset from the wearer's head 6 to provide the gap G. The gap G includes the forehead gap 84 discussed above, which extends generally along the wearer's forehead between the two front attachment locations 70. The gap G may also include innermost finger gaps 98 defined between the inner surface 58 and the innermost fingers 60 *c*, 60 *d*, and which extend generally from the forehead gap 84 rearwardly to the first rear attachment locations 72. The gap G may also include intermediate finger gaps 102 defined between the inner surface 58 and the intermediate fingers 60 *b*, 60 *e*, and which extend generally from the forehead gap 84 rearwardly to the second rear attachment locations 80. The gap G may also be formed partially, or entirely, with prongs 342 or other suitable structure coupled to attachment locations, fingers, webs, nets, straps, flexible headbands, or other supporting structures within the helmet that contact the head of the user and provide offset with respect to the inner surface 58 of the helmet. The other suitable structures used in forming and maintaining the gap may further comprise a stabilizing structure coupled to attachment locations, fingers, webs, nets, straps, flexible headbands, or other supporting structures within the helmet to hold the flexible forehead strap in place and to ensure a proper helmet fit and position, and to eliminate or reduce undesired movement or shifting of the helmet on the head of the user.

Figure 15:
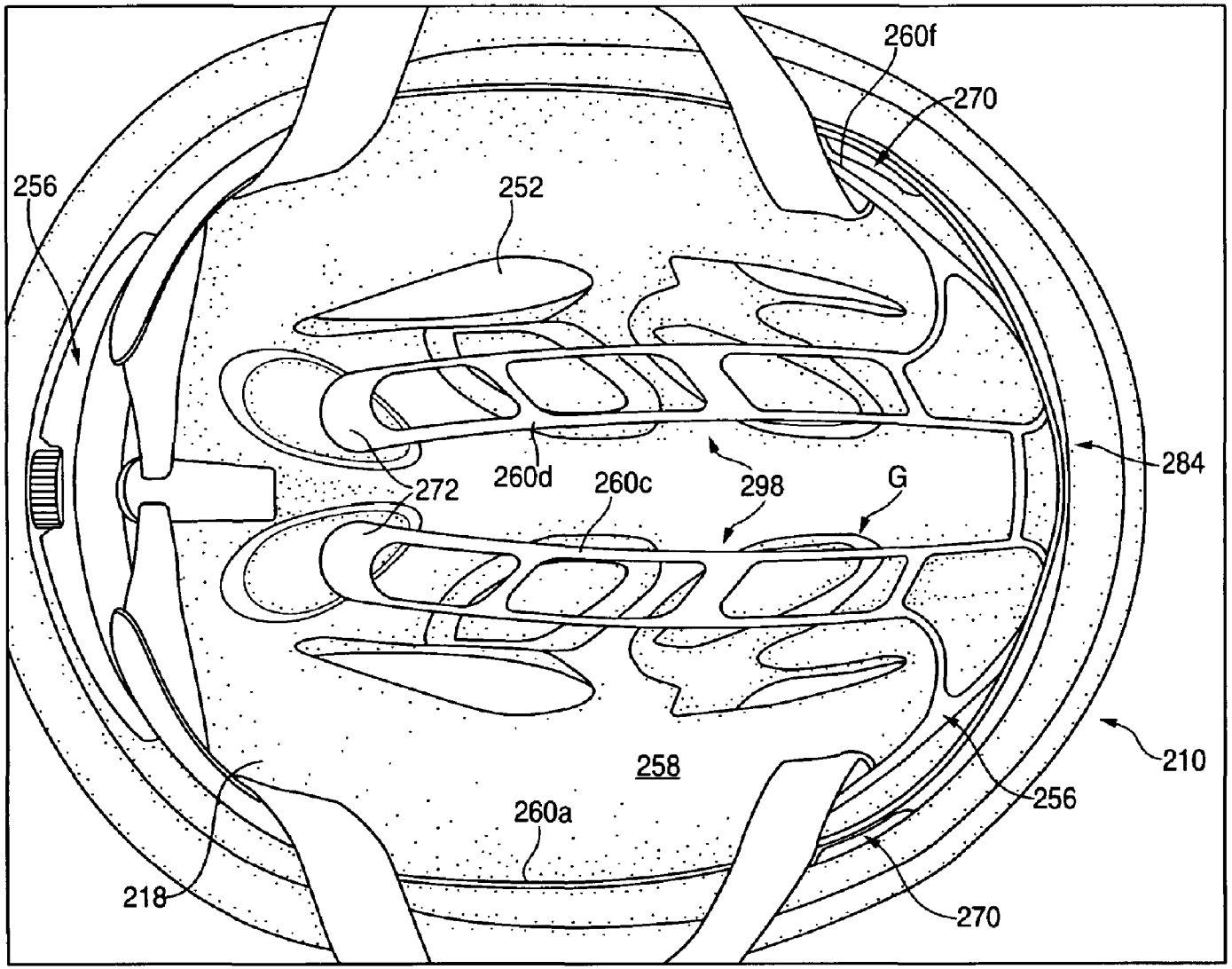
FIG. 15 is a bottom view of the helmet of FIG. 14 showing an alternative embodiment of an internal ventilation system.
Figure 16:
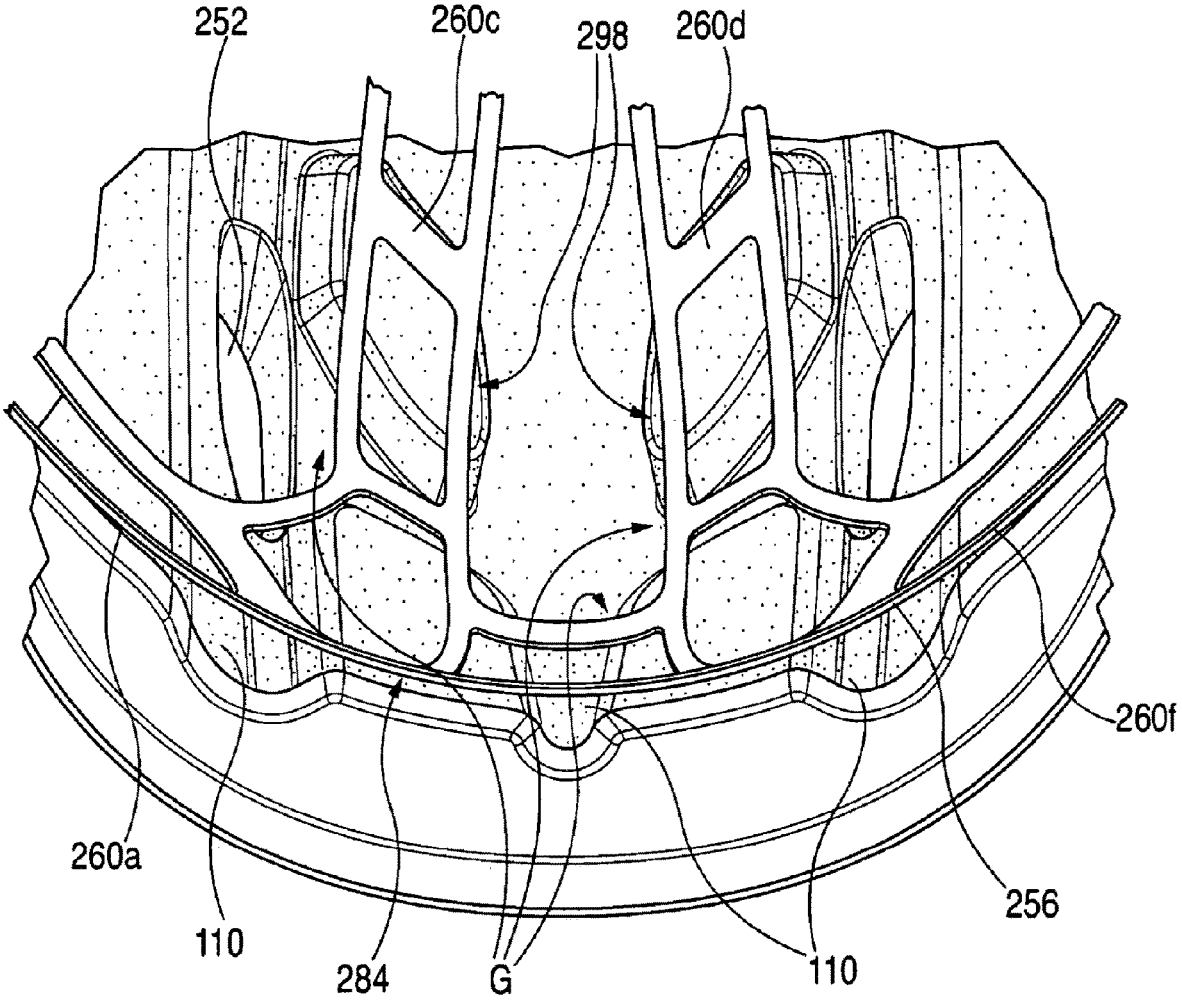
FIG. 16 is an enlarged bottom view of a frontal portion of the helmet of FIG. 14.
Figure 17:
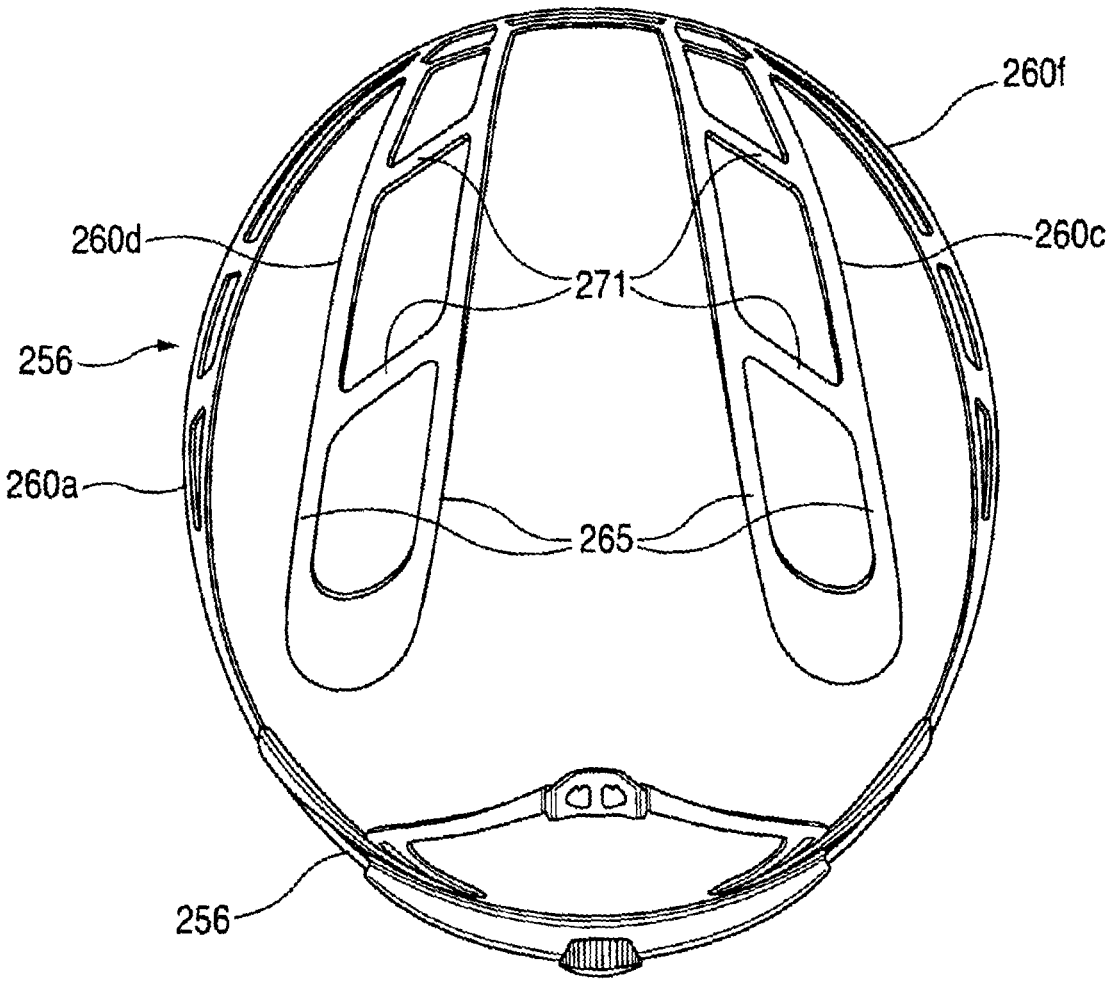
FIG. 17 is a top view of the alternative internal ventilation system removed from the helmet of FIG. 14.

FIGS. 14-17 illustrate an alternative embodiment where features of the alternative embodiment corresponding to features of the embodiment shown in FIGS. 1-13 have been given like reference numbers increased by 200. The helmet 210 of FIGS. 14-17 is what is known in the art as a sprinter helmet. As shown, the helmet 210 has far fewer ventilation openings 252 than the road helmet of FIGS. 1-13. As shown in FIGS. 15-17, the internal ventilation system 256 includes a web, mesh, or array that may include outer fingers 260 *a*, 260 *f*, that extend into an adjustment mechanism 226, and a pair of inner fingers 260 *c*, 260 *d*. In the alternative embodiment, the intermediate fingers have been eliminated, and the inner fingers 260 *c*, 260 *d*, which include rails 265 and ribs 271 (FIG. 17), have been widened.

The internal ventilation system 256 is attached to the inner layer 218 at front mounting locations 270, and rear mounting locations 272 (FIG. 15) and may be offset from the inner surface 258 of the inner layer 218 with prongs 342 or other similar structure. The front and rear mounting locations 270 and 272 are offset from the inner surface 258 of the inner layer 218 such that, when the helmet 210 is worn, the internal ventilation system 256 provides a gap G between the wearer's head 6 and the inner surface 258. As shown in FIG. 16, the gap G also includes a forehead gap 284 such that air contacting the wearer's forehead can flow upwardly between the wearer's forehead and the inner surface 258 of the inner layer 218. The gap G also includes inner finger gaps 298 between the inner fingers 260 *c*, 260 *d* and the inner surface 258. Say the gap G may also be formed or defined by the standoff structures, prongs such as prongs 342, or by other suitable structures. In the alternative embodiment of FIGS. 14-17, the inner layer 218 is provided with recessed channels 110 that communicate with the forehead gap 284 to provide additional air flow into the gap G between the surface of the wearer's head and the inner surface 258.

By spacing the inner surface 58, 258 of the helmet 10, 210 away from the wearer's head 6 and creating the gap G, ventilating air flows between the wearer's head 6 and the helmet 10, 210 (see, e.g., FIG. 4, FIG. 15, FIG. 16, FIG. 19A, and FIG. 19B), thereby improving ventilation and reducing heat build-up within the helmet 10, 210, which in turn helps to cool the wearer's head 6. When moving in a forward direction relative to the ground, such as when the cyclist 2 pedals the bicycle 4, air proximate the wearer's forehead flows upwardly through the forehead gap 84, 284 and then generally rearwardly, around, and through the gap G, including along the user's head, the innermost finger gaps 98, 298 and intermediate finger gaps 102, or along a mesh, web, forehead strap, or other supporting structure. Air can then exit the helmet 10, 210 through one of the ventilation openings 52, 252 provided in the rear portion 38 of the helmet 10. Furthermore, because the first and second rear attachment locations 72, 80 (in helmet 10), and the rear attachment locations 272 are laterally spaced apart from each other, air is also permitted to flow generally downwardly between the various rear attachment locations 72, 80, 272 and can exit the helmet 10 by flowing generally downwardly and over the back of the wearer's neck. Such downwardly-directed flow that passes over the back of the wearer's neck may be particularly prominent in embodiments like the embodiment of FIGS. 14-17 or in the aero helmet discussed above, which have few or no ventilation openings 52, 252 through which the air might otherwise exit the helmet 210. Thus, with the exception of the extremely small surface area of the wearer's head 6 that is in intimate contact with the fingers 60, 260, substantially the entire surface of the wearer's head 6 is exposed to ventilating air flow through the gap G. In instances where a cloth, fabric or textile mesh, web, or filament is employed, a smaller or more dispersed area of the head of the user 2 may be covered. The structure of the internal ventilation systems 56, 256 discussed above maintain the gap G between the inner helmet surface 58, 258 and the wearer's head 6 while the respective helmet 10, 210 is worn during the cycling activity.

Figure 18:
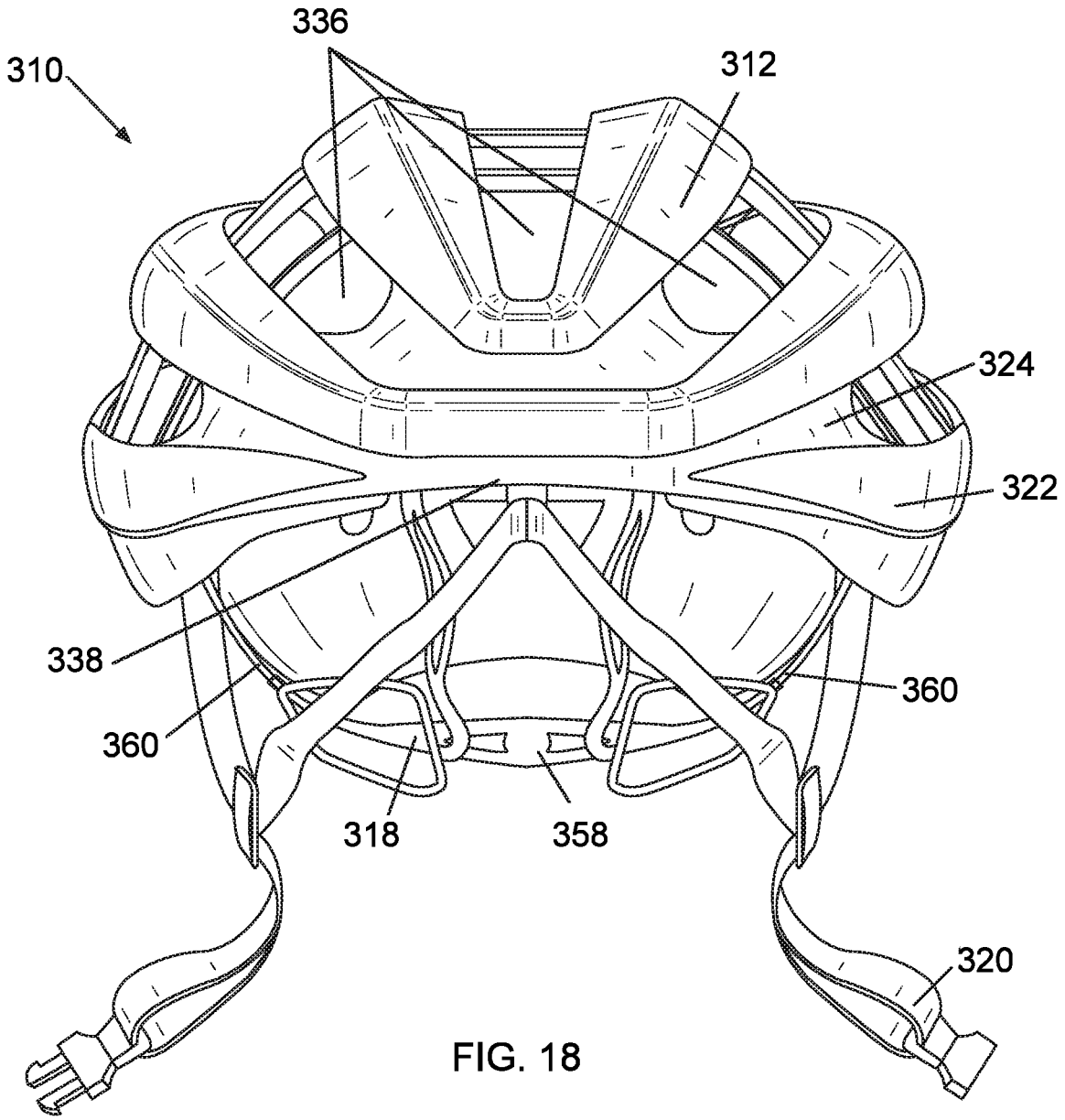
FIG. 18 is a front view of an embodiment of a bicycle helmet with a fit system and internal ventilation system.
Figure 19A:
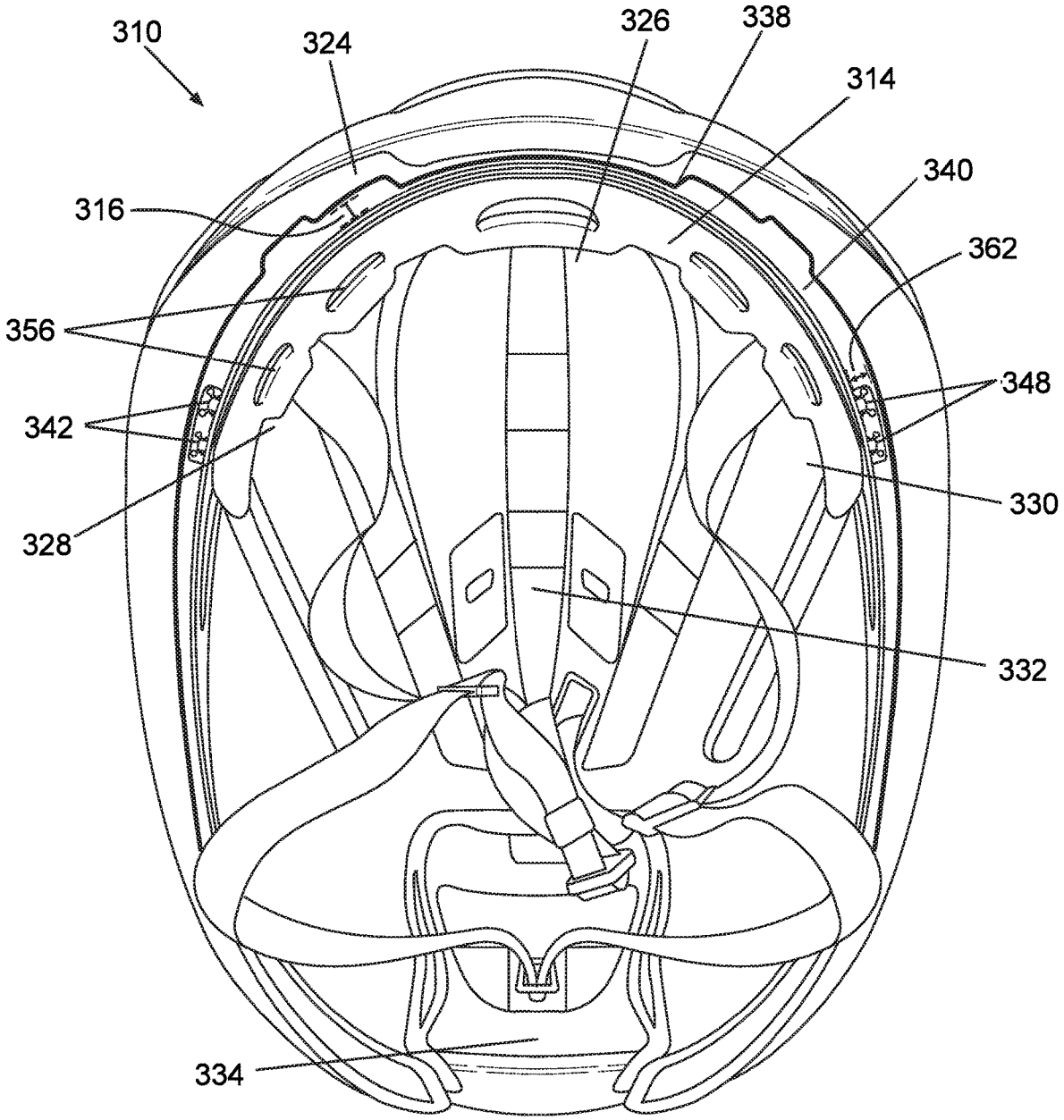
FIG. 19A is a bottom view of an embodiment of a bicycle helmet with a fit system and internal ventilation system.
Figure 19B:
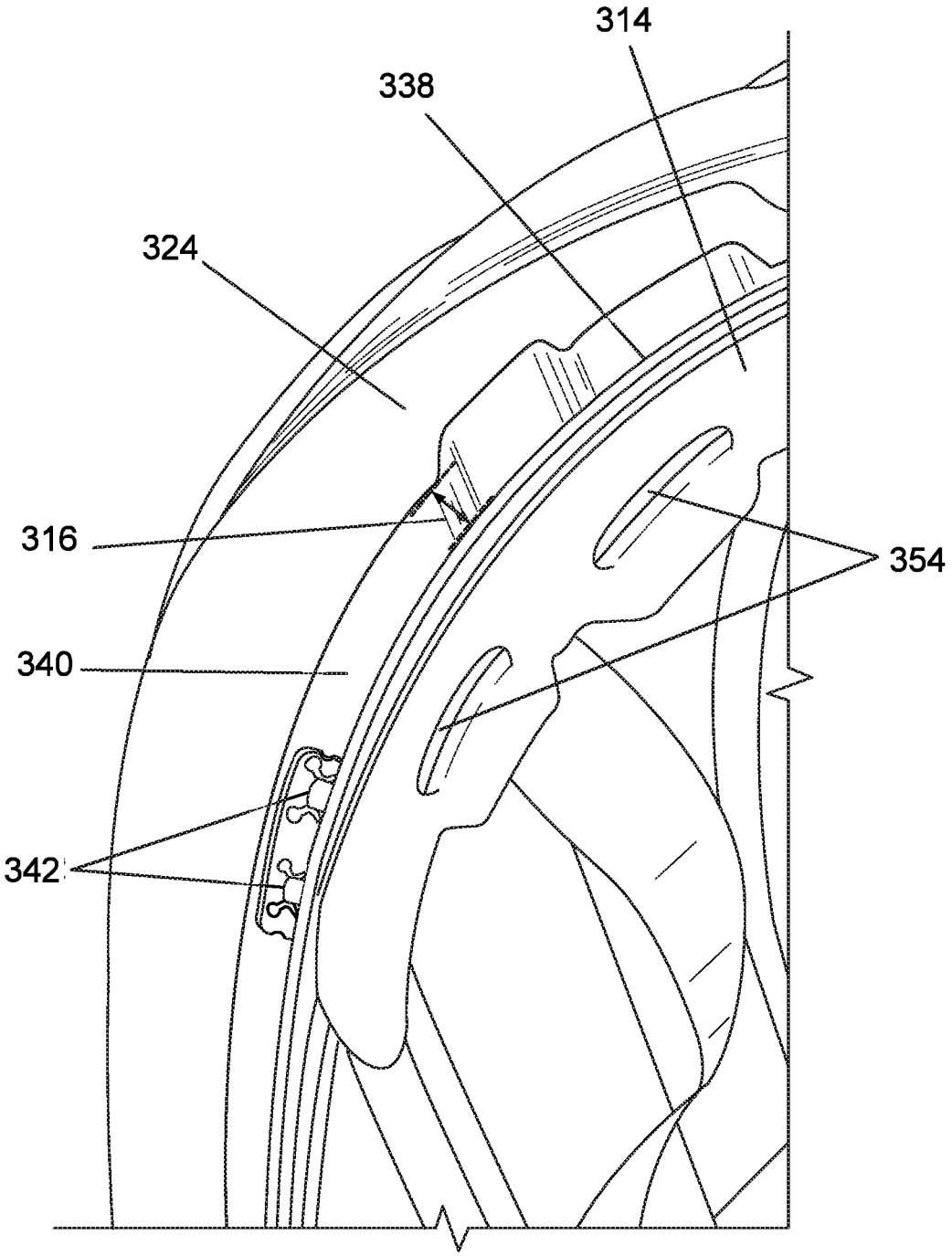
FIG. 19B is a close-up view of a portion of the helmet of FIG. 19A surrounding the connectors.
Figure 20:
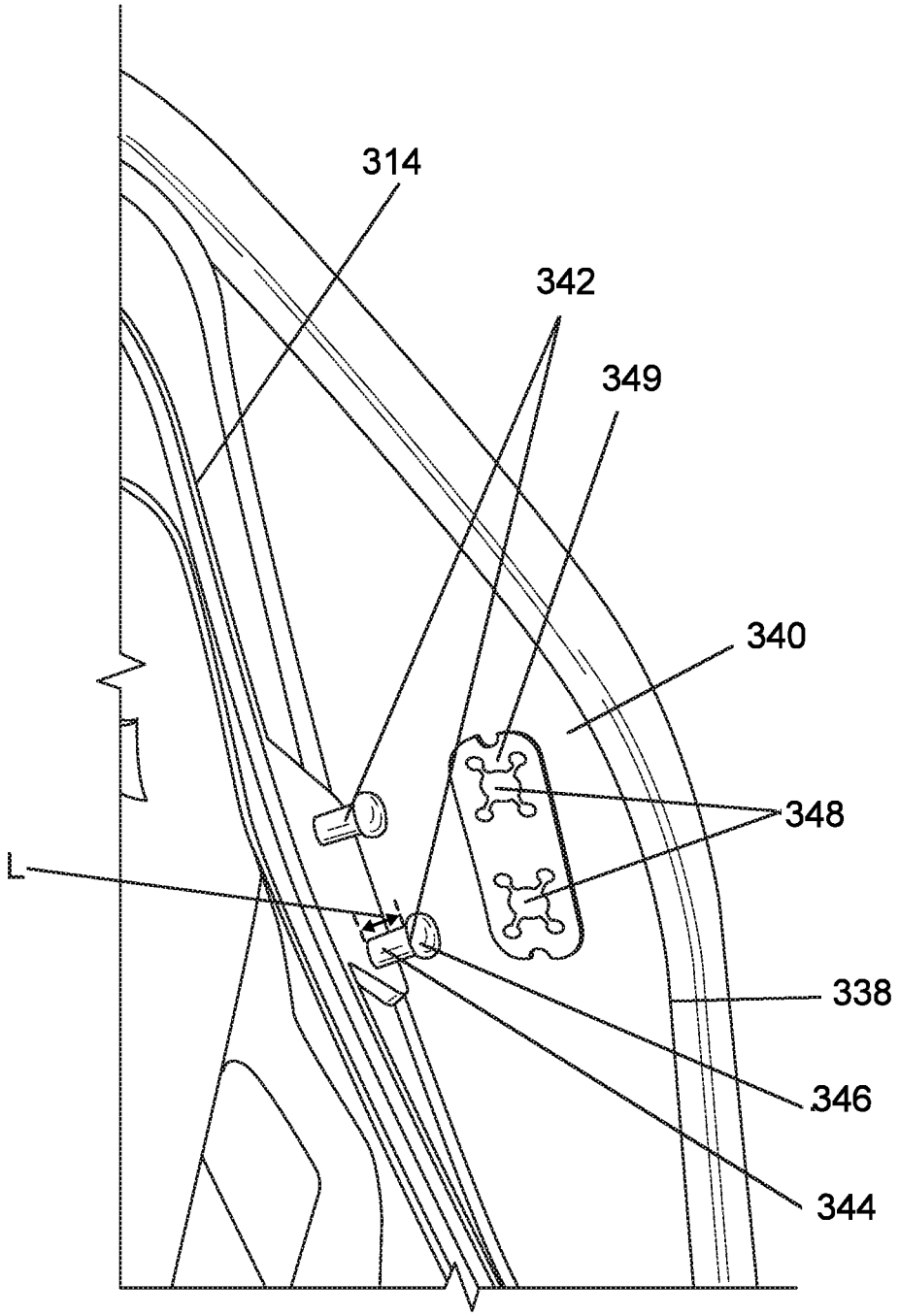
FIG. 20 is a close-up view of a portion of the helmet of FIG. 19A with the forehead strap and fit system removed to show the connector receivers.

FIGS. 18-20 illustrate an embodiment of a bicycle helmet 310 including a liner or helmet liner 312, a flexible forehead strap 314, a continuous gap 316, an adjustable connector 318, and a chinstrap 320. In some embodiments the liner 312 comprises an outer shell 322 and an energy management layer 324. In some embodiments, only the energy management layer 324 is used. The outer shell 322 may comprise a plastic material, such as polycarbonate; however, in other embodiments, the outer shell 322 may also or alternatively comprise KEVLAR, ABS plastic, carbon fiber, fiberglass, and the like. In some embodiments, the energy management layer 324 may comprise EPS, EPP, EPO, or other suitable energy management or energy absorbing material. The chinstrap 320 includes connectable segments which may be attached to one or both of the outer shell 322 and the energy management layer 324 for securing the helmet 310 to the user's head 6, as generally known in the art. The energy management layer 324 includes an inner surface 340 which has a front portion 326 that overlies the user's forehead with a right front portion 328 on the right and a left front portion 330 on the left, a top portion 332 that overlies the crown region of the user's head 6, and a rear portion 334 that overlies at least a portion of the occipital region of the user's head.

The helmet 310 embodiments of FIGS. 18 and 19A are commonly recognized in the cycling field as "road" helmets and are designed for general use during recreational and certain types of competitive cycling, as discussed above with respect to FIGS. 14-17. It should be appreciated that the principles and teachings discussed herein are equally applicable to other types of bicycle helmets, such as a "sprinter" helmet, an "aero" helmet, and any other helmets that include a fit system or an adjustable fit system inside the helmet, as discussed, e.g., with respect to FIGS. 14-17. As understood by those in the art, a sprinter helmet is designed to be more aerodynamic than a typical road helmet, and as such has a more smoothly contoured outer shell 322 and fewer ventilation openings 336. As also understood by those in the art, an aero helmet is designed to be even more aerodynamic, having a substantially streamlined shape that resembles a "tear-drop" configuration. Aero helmets are also configured to have as few ventilation openings 336 as possible, and in many cases have no ventilation openings 336 whatsoever. As those skilled in the art will appreciate, the benefits and advantages associated with the concepts and teachings discussed herein may become more apparent to the user as the number of ventilation openings 336 in the helmet 310 decrease.

Referring also to FIGS. 18-20, the helmet 310 includes at least one flexible forehead strap 314 that extends around a lower edge 338 of the energy management layer 324 and adjustably contacts the user's head 6 to support the helmet 310 while defining a continuous gap 316 between the user's head 6 and an inner surface 340 of the energy management layer 324. In some embodiments, flexible forehead straps 314 also extend over the user's head 6 from the user's forehead region over the crown region and to the occipital region. In such embodiments, the continuous gap 316 may also extend across the outer surface of the user's head 6 from the user's forehead region over the crown region and to the occipital region (see FIG. 22 for example). The least one flexible forehead strap 314 may following the lower edge of the energy management layer and be inwardly offset from the inner surface. As a person of ordinary skill will appreciate, the lower edge of the energy management layer may have variations, ups and downs, notches, crenellations, or other variations to accommodate for helmet design and helmet aesthetics, and the flexible forehead strap 314 may follow the lower edge of the energy management layer without follow the lower edge of the energy management layer without following these variations.

As illustrated in FIGS. 18-21B, the flexible forehead strap 314 includes at least two or more prongs 342 extending from an outer surface of the flexible forehead strap 314 for coupling into corresponding coupling points 348 on the inner surface 340 of the energy management layer 324. The two or more prongs or blades may be positioned near the temple region of the helmet, which will align with or be disposed over the temples of the user when the helmet is worn. In some instances, at least one of the two or more prongs may comprise a pair of prongs, which is shown, e.g., in FIG. 19A with two members 342 at each of the two or more prong locations. When prongs 342 are formed with a circular cross-section, there may be a tendency for the flexible forehead strap 314 to rotate undesirably. By including two prongs at each of the two or more locations, rotation is reduced, minimized, eliminated or substantially eliminated. In some instances, rather than a circular cross-section, rotation may be reduced, minimized, eliminated or substantially eliminated by forming one or both of the two or more prongs as blades, which would have a length or width that could have ends or edges at the location of the two prongs 342, and material that extends between the position of the pairs of two prongs 342 for each of the two or more prong locations, such that the elongated opening and blade shaped prong prevent, reduce, minimize, eliminate or substantially eliminate undesired rotation. In addition to pairs of prongs 342 and blade shaped prongs, other stabilizing structures may also be coupled to the forehead strap.

The two or more prongs 342 provide a different structure and approach from what has been done with previous helmets (as shown for example in FIG. 23), thus extending the connecting junction between the flexible forehead strap 314 and the energy management layer 324 with prongs 342 and creating a continuous gap 316 or G between the flexible forehead strap 314 and the inner surface 340 of the energy management layer 324. Each prong 342 extends outward, away from the flexible forehead strap 314 and may include a stem 344 and a head 346. The stem 344 includes a length "L" long enough to span the continuous gap 316 and allow the head 346 to couple with a corresponding coupling point 348 on the inner surface 340 of the energy management layer 324.

The coupling points 348 may be receivers comprising a flexible entrance 349 that allows the head 346, when force is applied, to pass through the flexible entrance 349 to the receivers and restrict its flexible entrance 349 size to smaller than the largest dimension of the head 346 after the head 346 has passed through the flexible entrance 349 into the receiver. The coupling points 348 may be in-molded into the energy management material when the energy management material is formed, or added thereafter using methods known in the art. The head 346 of the prong 342 may be formed in a variety of shapes. As shown in FIG. 20, the prong 342 may have a bulbous or mushroom-shaped head 346 which is capable of snapping into the coupling point 348. Alternatively, the head 346 may be T-shaped or any other shape, and may couple with the coupling point 348 in a variety of ways, such as through the use of adhesives, clips, clamps, snaps, hook and loop, or other types of fasteners. In some embodiments, the inside of the connection points 348 are deeper than the largest dimension of the head 346 so that when the head 346 is received in the connection point 348, the head 346 can still move within the connection point 348 to allow for an adaptable continuous gap 316 that further helps to adapt the fit system more comfortably to a wearer's head shape and dimensions by allowing for additional movement between the fit system and the inner surface 340 of the energy management layer 324.

Figure 21A:
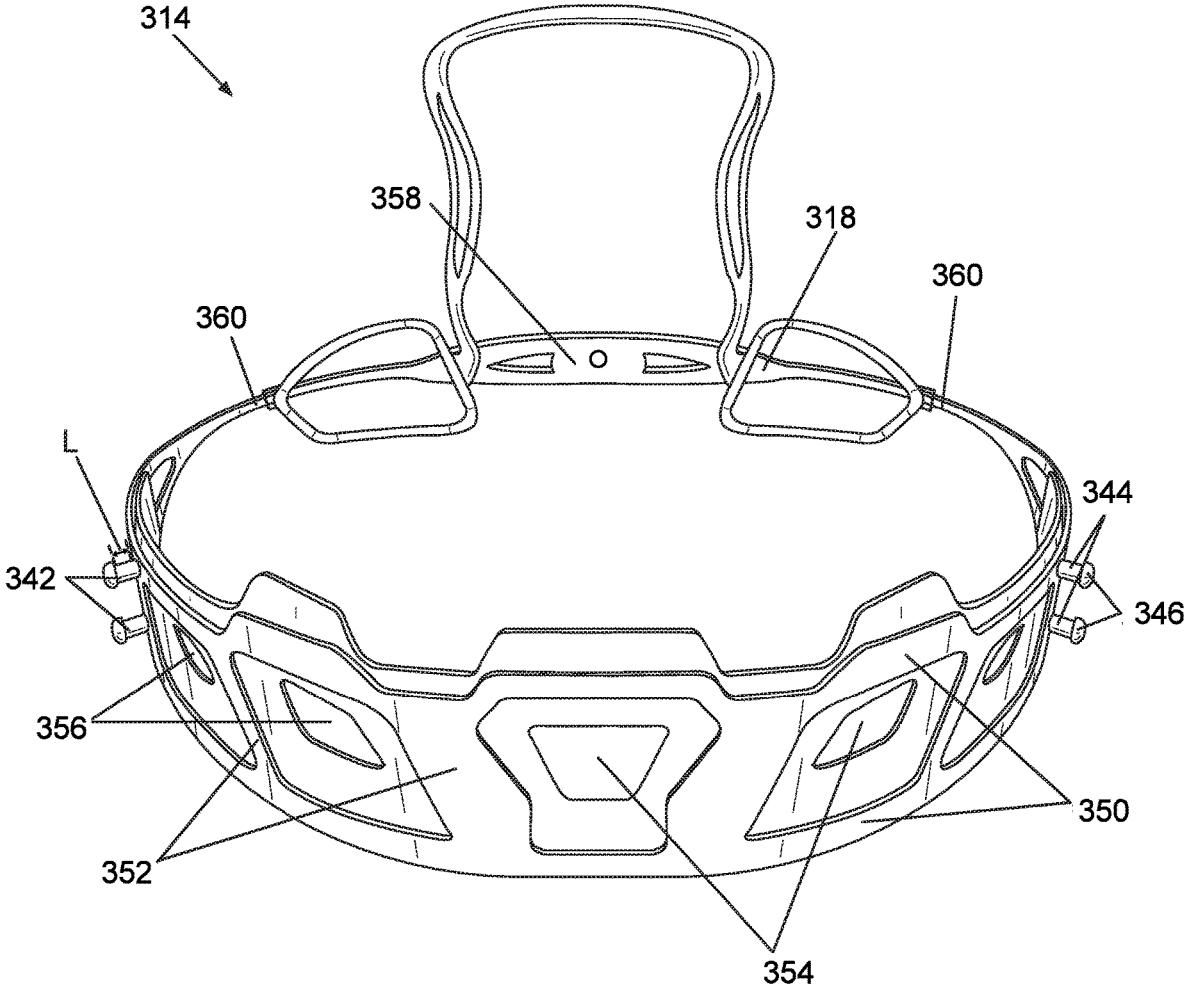
FIG. 21A is a front view of a forehead strap of a fit system.
Figure 21B:
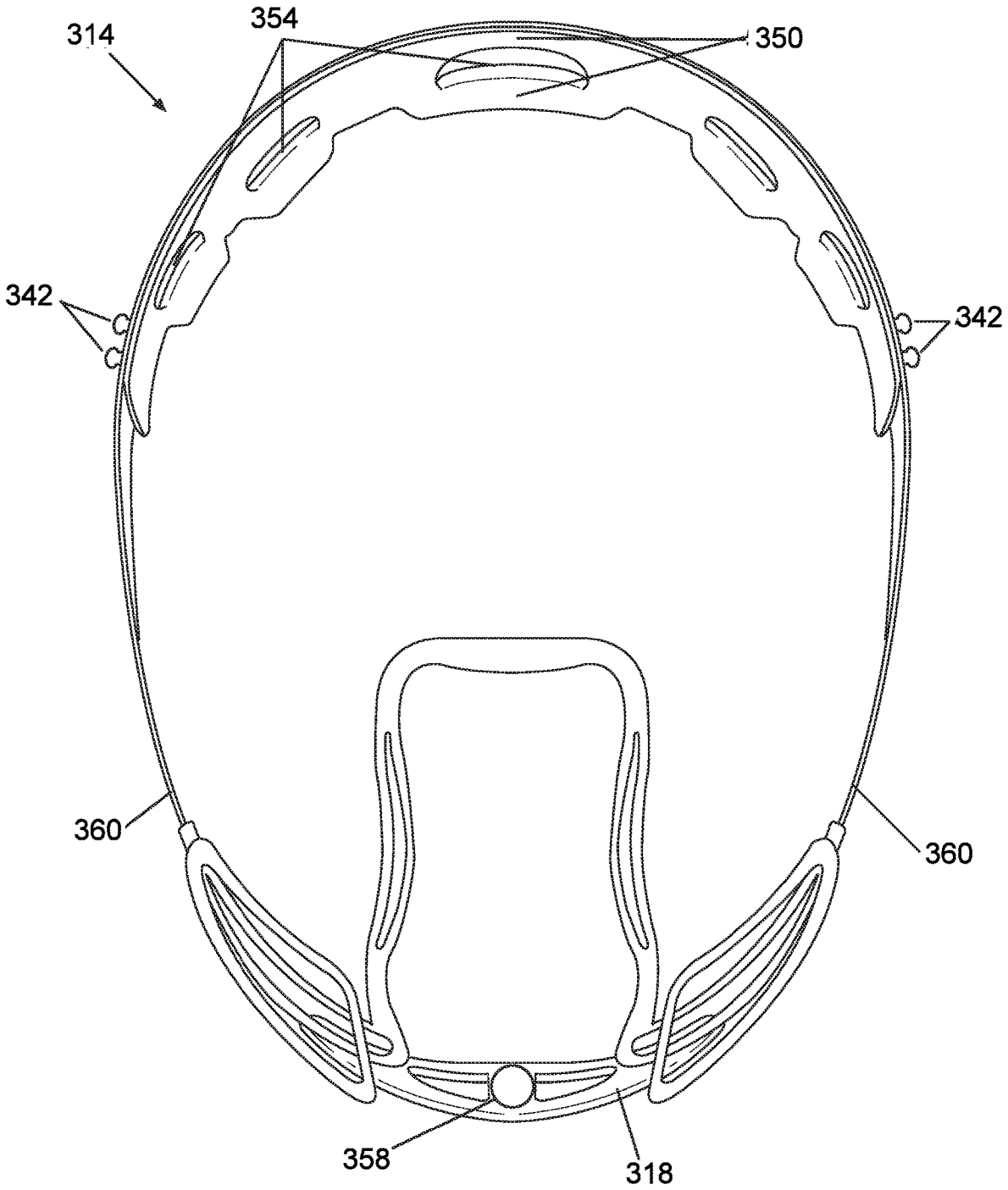
FIG. 21B is a top view of the forehead strap of FIG. 21A.

As shown in FIG. 21A, each of the flexible forehead straps 314 may have a pair of rails 350 intermittently joined by transverse ribs 352. The rails 350 and the ribs 352 cooperate to define a web, mesh, or plurality of ventilation apertures 354 in the flexible forehead straps 314 in the form of generally elongated slots 356. The ventilation apertures 354 can further improve the ventilating characteristics of the flexible forehead straps 314 by reducing or minimizing the total surface area of the flexible forehead straps 314 that is in intimate contact with the user's head 6. Alternatively, the flexible forehead straps 314 may be configured with a single rail 350 that precludes the apertures 354. Some embodiments of the flexible forehead straps 314 are formed of a substantially rigid but flexible material, such as rubber, plastic, carbon fiber, and the like. The flexible forehead straps 314 may also include an additional material, such as a coating or additional comfort padding, to facilitate engagement with the user's head 6.

When the helmet 310 is properly worn, the flexible forehead strap 314 extends laterally from the user's forehead, around the sides of the user's head 6, passing approximately over the user's temples 64 (FIGS. 1 and 22), and into the adjustable connector 318 (FIGS. 18 and 21A). In some embodiments, including the embodiment illustrated in FIG. 18, the adjustable connector 318 is configured for direct engagement with the user's head 6 and includes an actuator 358 (such as a dial, knob, or other adjustor that reels in or pays out the ends 360 of the flexible forehead strap 314) to adjust the perimeter of the flexible forehead strap 314. For example, by reeling in the ends 360 of the flexible forehead strap 314, the flexible forehead strap 314 is tightened against the user's head 6, whereas by paying out the ends 360 of the flexible forehead strap 314, the flexible forehead strap 314 is loosened from the user's head 6. In this regard, the flexible forehead strap 314 is adjustable to account for the size of the user's head 6. It should be understood that the use, and incorporation, of the adjustable connector 318 with the flexible forehead strap 314 is not required. For example, in some embodiments, the flexible forehead strap 314 may be of a substantially fixed size and configuration, wherein such variations in the size or shape of a user's head may be accommodated by the flexibility of the materials of the forehead strap 314. Some embodiments may also or alternatively include fit adjusting components or structure distinct from the flexible forehead strap 314. For example, in one exemplary embodiment, the ends 360 of the flexible forehead strap 314 terminate near the rear portion 334 of the energy management layer 324, and a separate strap, band, or similar structure may be provided that extends generally around the rear occipital region of the user's head 6. The strap, band, or similar structure may be formed of a resilient material, such as elastic, and may therefore be inherently adjustable, or the strap, band or similar structure may be operably connected to an adjustable connector similar to the adjustable connector 318 discussed above.

Referring specifically to FIG. 19A, in particular embodiments, the continuous gap 316 extends around the entirety of the lower edge 338 of the energy management layer 324, defined on either side by the inner surface 340 of the energy management layer 324 and the flexible forehead strap 314. In particular embodiments, the continuous gap 316 is maintained at least for the front half of the helmet. In some embodiments, the continuous gap measures between 0.159-0.635 cm (1/16 inch and 1/4 inch). The prongs 342 are elongated (FIG. 18) as compared to conventional prongs (see FIG. 23), allowing some movement of the helmet 310 in relation to the adjustable connector 318 and the user's head 6. Because the stem 344 of each prong 342 is thinner than the flexible entrance 349, and the connection points 348 in the helmet 310 are deeper than the size of the prong head 346, the gap 316 is a flexible gap that can extend to its maximum size, or can collapse to a smaller size if necessary, allowing the helmet 310 to "float" in relation to the flexible forehead strap 314 and allow the helmet's adjustable connector 318 to better adapt to particular head shapes and sizes. When the helmet 310 is worn, the flexible forehead strap 314 intimately contacts the user's head 6, while the inner surface 340 of the helmet 310 is spaced away from the user's head 6 to form the continuous gap 316.

The continuous gap 316 includes a coupling point gap 362 which is located at each coupling point 348. Specifically, the continuous gap 316 is not blocked at each coupling point 348 by the coupling of the flexible forehead strap 314 to the inner surface 340, but rather remains open, as shown. This allows the airflow to enter the gap 316 at any location along the lower edge 338 of the energy management layer 324 without restraint.

Referring to FIG. 20, the energy management layer 324 includes at least one coupling point 348 on each side of the front of the helmet, and in particular embodiments two coupling points 348 on each side, located proximal to a lower edge 338 of the energy management layer 324. In the illustrated embodiment, the coupling points 348 are located approximately one-quarter to one-third of the helmet periphery from the front center 326 of the energy management layer 324, with at least one coupling point 348 located on each side of the helmet 310. Alternatively, the coupling points 348 may be located anywhere along the lower edge 338 of the energy management layer 324, and additional coupling points 348 may also be located anywhere on the inner surface 340. In some embodiments, including the embodiment illustrated in FIG. 19B, the coupling points 348 are integrally formed with the energy management layer 324, and are substantially flush with the inner surface 340 of the helmet 310. The elongated prongs 342 maintain the continuous gap 316 by keeping the flexible forehead strap 314 further inward than the inner surface 340. Other embodiments may include coupling points 348 in the form of raised projections that extend generally inwardly, and standoffs, posts, spacers, and the like that are joined to the energy management layer 324. In the illustrated embodiment, the flexible forehead straps 314 are secured to the coupling points 348 with the prongs 342. However, in other embodiments the flexible forehead strap 314 can be secured to the coupling points 342 by clips, clamps, snaps, hook and loop, and other types of fasteners.

Figure 22:
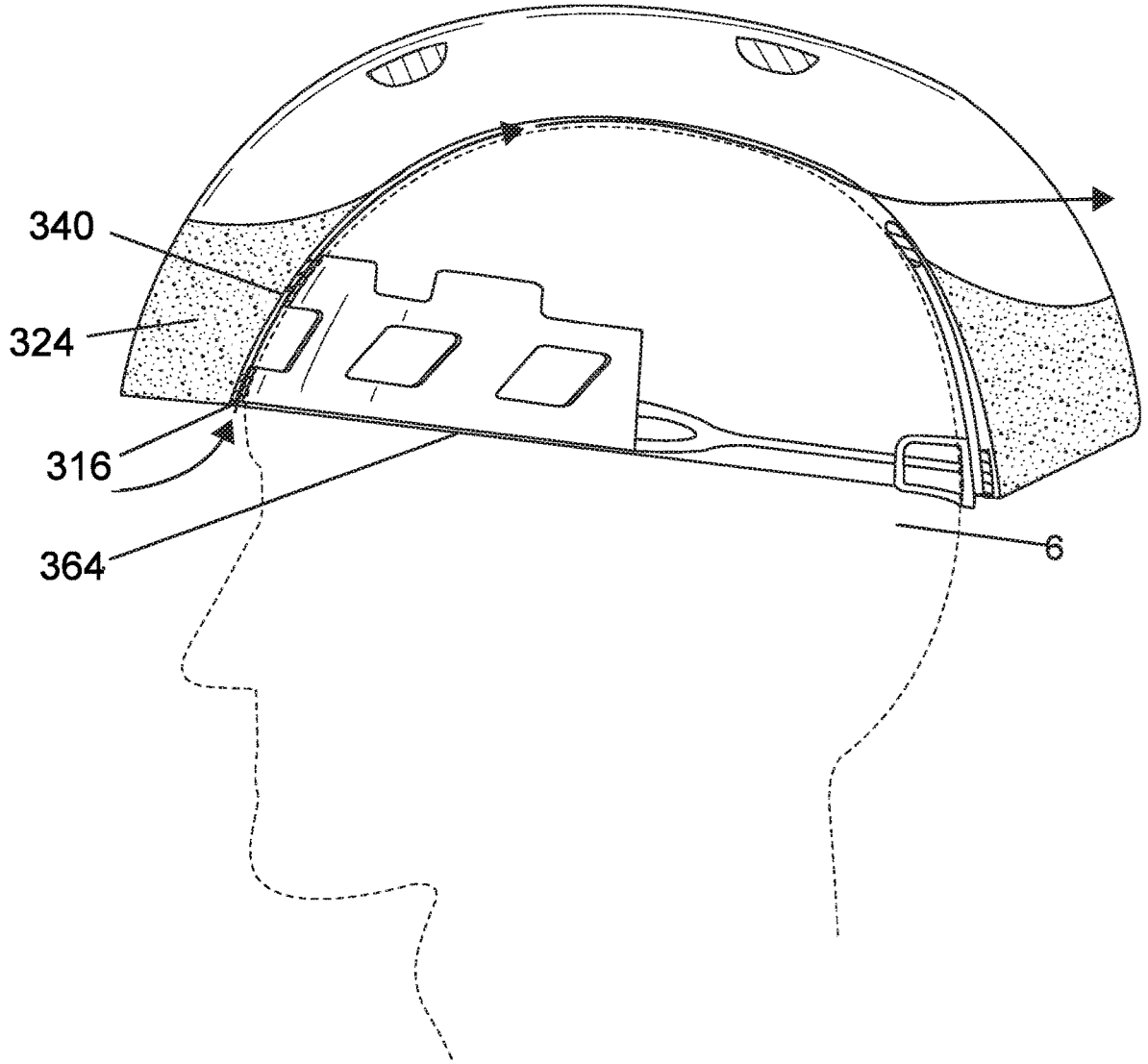
FIG. 22 is a schematic side view showing the helmet of FIG. 18 in partial section and secured to the head of a user showing airflow through the helmet.

Referring to FIG. 22, the continuous gap 316 allows air to enter between the energy management layer 324 and the user's head 6. With the inner surface 340 of the energy management layer 324 spaced apart from the user's head 6, ventilating air can flow through the continuous gap 316 and between the user's head 6 and the inner surface 340. This continuous gap 316 is provided in helmets having several ventilation openings 336 and also is provided in helmets having few or no ventilation openings 336, such as the sprinter and aero helmets discussed above. Heat build-up and retention inside of the helmet may thus be reduced.

Figure 23:
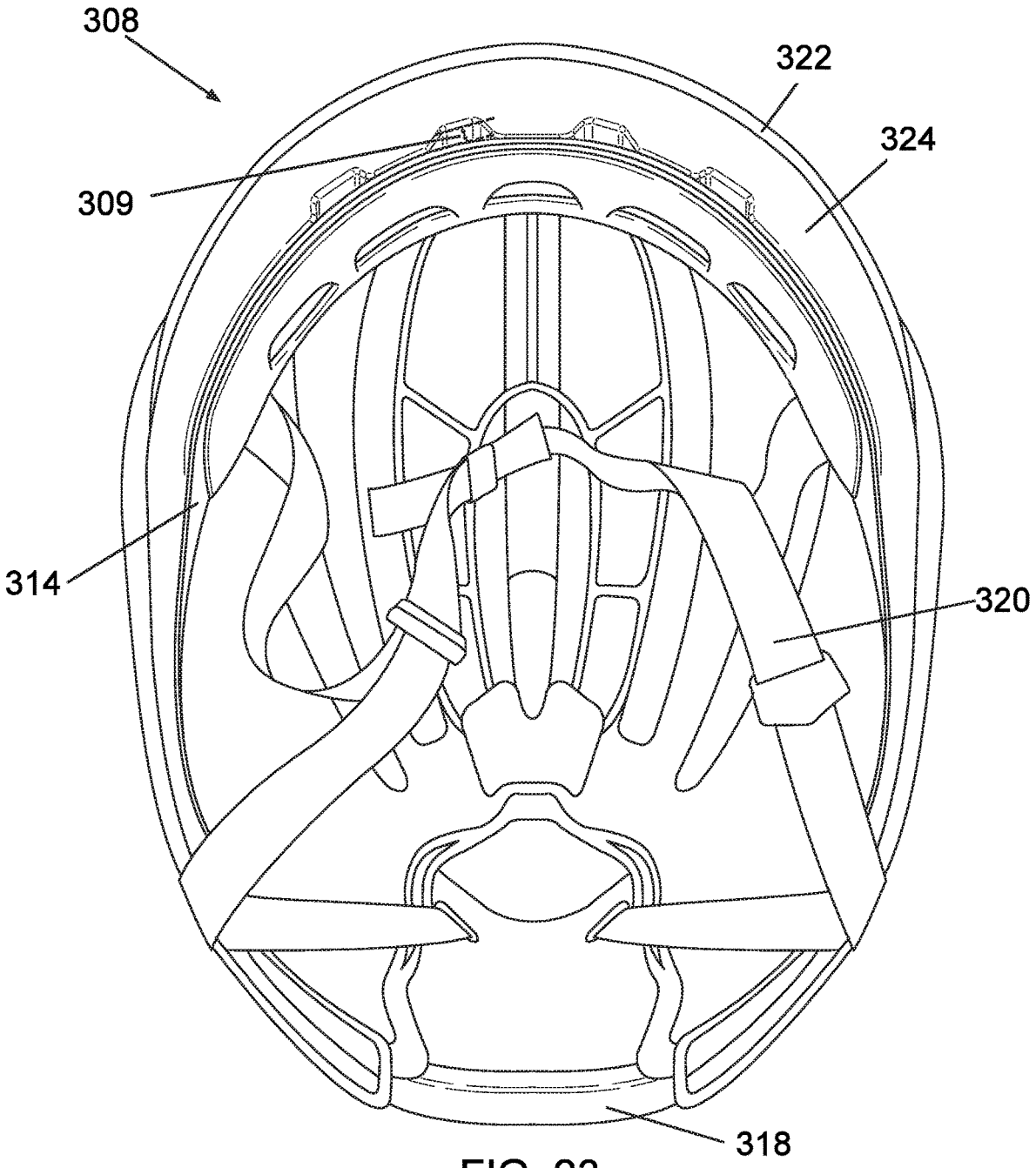
FIG. 23 PRIOR ART
FIG. 23 is a bottom view of a prior art helmet showing the coupling point where the forehead strap is in contact with the inner liner.

As such, helmet 31, like helmet 10, provides a number of advantages over conventional helmets, such as helmet 308 shown in FIG. 23. FIG. 23 illustrates the helmet 308 has a liner 312 comprising an outer shell 322 and an energy management layer 324, a flexible forehead strap 314, an adjustable connector 318, and a chinstrap 320. However, gap 309 at the front of the helmet 308 between the flexible forehead strap 314 and the energy management layer 324, at the points where the flexible forehead strap 314 is coupled to the energy management layer 324, is securely and closely coupled without a gap between the flexible forehead strap 314 and the energy management layer 324. This non-gapped connection restricts some of the air flow through the helmet and the fit system. Thus, the non-gapped connection shown in FIG. 23 provides neither a clear path nor the benefits of cooling as provided and described above with respect to helmets 10, 310.

Furthermore, helmet 310 also provides the additional advantage that one or more of pinch points, sharp changes in angle, crimps, and undesired bending are reduced because flexible forehead strap 314 floats with respect to the connection points 348 in the helmet and can move with prongs 342, including when a size or circumference of the forehead strap 314 is adjusted.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the disclosure.

What is claimed is:

1. A helmet for protecting the head of a user, the helmet comprising:

at least one liner comprising an inner surface and a lower edge surrounding the inner surface at a helmet opening configured to receive a head of a helmet wearer;

at least two coupling points located on the inner surface proximal to the lower edge;

at least one flexible forehead strap following the lower edge of the at least one liner and inwardly offset from the inner surface;

at least two prongs configured to slidably couple the flexible forehead strap and the at least one liner, the at least two prongs being configured to slide into and out of the at least two coupling points; and a continuous gap between the inner surface and the flexible forehead strap provided by an offset created by the at least two prongs, the continuous gap being a flexible gap configured to extend between a maximum size and a smaller size via sliding movement of the at least two prongs into and out of a flexible entrance of each coupling point to thereby allow the flexible forehead strap to float relative to the helmet.

2. The helmet of claim 1, wherein the at least two prongs comprise a stem and a head, the head having a larger cross-section than a cross-section of the stem, wherein the stem is attached to and projects away from the flexible forehead strap towards the inner surface and the head couples with the inner surface at one of the at least two coupling points.

3. The helmet of claim 1, wherein the continuous gap between the inner surface and the flexible forehead strap is maintained by the offset created by the at least two prongs, the at least two prongs coupled to the flexible forehead strap to reduce pinch points on the flexible forehead strap for the user.

4. The helmet of claim 1, further comprising an adjustable connector coupled to each end of the at least one flexible forehead strap and capable of adjusting a perimeter of the flexible forehead strap, wherein the adjustable connector comprises a knob that decreases the perimeter when rotated in a first direction and increases the perimeter when rotated in a second direction different from the first direction.

5. The helmet of claim 1, the at least two coupling points each comprising a hole wherein a length of the stem is greater than a depth of the hole and the stem is slidably coupled within the hole.

6. The helmet of claim 1, the at least one flexible forehead strap further comprising a pair of rails intermittently joined by transverse ribs, the rails and the ribs cooperatively coupled to define a plurality of ventilation apertures in the at least one flexible forehead strap in the form of elongated slots.

7. A helmet for protecting the head of a user, the helmet comprising:

at least one liner comprising an outer shell and an energy management layer, the energy management layer comprising an inner surface and a lower edge surrounding the inner surface at a helmet opening configured to receive a head of a helmet wearer;

at least one coupling point located on the inner surface adjacent the lower edge;

at least one flexible forehead strap following the lower edge of the energy management layer, inwardly offset from the inner surface, and coupled to the inner surface at the at least one coupling point;

a coupling point gap separating the inner surface from the flexible forehead strap at each coupling point, the coupling point gap being a flexible gap configured to extend between a maximum size and a smaller size to thereby adapt the helmet to the head of the helmet wearer; and an adjustable connector coupled to the at least one flexible forehead strap and configured to adjust a perimeter of the flexible forehead strap.

8. The helmet of claim 7, further comprising at least two prongs configured to slidably couple the at least one flexible forehead strap and the at least one liner, wherein each prong comprises a stem and a head, wherein the at least one coupling point comprises a hole, and wherein the stem is slidably coupled with the hole and a portion of the stem is configured to remain outside of the hole.

9. The helmet of claim 8, the at least one coupling point comprising a first coupling point being located in a right front portion of the inner surface and a second coupling point being located in a left front portion of the inner surface.

10. The helmet of claim 8, the head having a larger cross-section than a cross-section of the stem, wherein the stem is attached to and projects away from the flexible forehead strap towards the inner surface and the head couples with the inner surface at the at least one coupling point.

11. The helmet of claim 9, wherein the at least two prongs comprise at least two pairs of prongs located on the flexible forehead strap and positioned to couple with the at least one coupling point.

12. The helmet of claim 7, wherein a length L of the coupling point gap is in a range of greater than 0.0 cm to 0.635 cm.

13. The helmet of claim 7, wherein the adjustable connector comprises a knob configured to decrease the perimeter when adjusted in a first direction and configured to increase the perimeter when adjusted in a second direction different from the first direction.

14. A helmet for protecting the head of a user, the helmet comprising:

at least one helmet liner comprising an outer shell and an energy management layer, the energy management layer comprising an inner surface and a lower edge surrounding the inner surface at a helmet opening configured to receive a head of a helmet wearer;

at least one coupling point located on the inner surface proximal to the lower edge;

at least one flexible forehead strap following the lower edge of the energy management layer, inwardly offset from the inner surface, and coupled to the inner surface at the at least one coupling point; and a continuous gap between the inner surface and the flexible forehead strap, including at the at least one coupling point, the continuous gap being a flexible gap configured to extend between a maximum size and a smaller size in response to the head of the helmet wearer.

15. The helmet of claim 14, further comprising at least two prongs that slidably couple the at least one flexible forehead strap and the at least one liner, wherein each prong comprises a stem and a head, wherein the at least one coupling point comprises a hole, and wherein a length of the stem is greater than a depth of the hole and a portion of the length of the stem is configured to remain outside of the hole.

16. The helmet of claim 15, wherein:

the at least one coupling point comprises at least two coupling points; and a first of the at least two coupling points is located in a right front portion of the inner surface proximal to the lower edge and a second of the at least two coupling points is located in a left front portion of the inner surface proximal to the lower edge, wherein the at least two coupling points are proximal to a helmet wearer's head temples when in use.

17. The helmet of claim 16, the head having a larger cross-section than a cross-section of the stem, wherein the stem is attached to and projects away from the flexible forehead strap towards the inner surface and the head couples with the inner surface at the at least one coupling point.

18. The helmet of claim 17, wherein the at least two prongs comprise at least two pairs of prongs, coupled to the flexible forehead strap and each prong of the at least two pairs of prongs coupled to each of the at least one coupling points.

19. The helmet of claim 18, the continuous gap having a length L at the at least two coupling points in a range of greater than 0.0 centimeters (cm) to 0.635 cm.

20. The helmet of claim 14, further comprising an adjustable connector coupled to the at least one flexible forehead strap and capable of adjusting a perimeter of the flexible forehead strap.

* * * * *